US008525614B2

(12) United States Patent
Fujiwara et al.

(10) Patent No.: US 8,525,614 B2
(45) Date of Patent: Sep. 3, 2013

(54) COUPLER

(75) Inventors: Toshiyasu Fujiwara, Tokyo (JP); Takeshi Suga, Tokyo (JP)

(73) Assignee: TDK Corporation, Tokyo (JP)

( * ) Notice: Subject to any disclaimer, the term of this patent is extended or adjusted under 35 U.S.C. 154(b) by 262 days.

(21) Appl. No.: 12/954,783

(22) Filed: Nov. 26, 2010

(65) Prior Publication Data

US 2011/0128091 A1 Jun. 2, 2011

(30) Foreign Application Priority Data

Nov. 30, 2009 (JP) ..... 2009-272227
Nov. 30, 2009 (JP) ..... 2009-272231

(51) Int. Cl.
*H01P 5/12* (2006.01)
*H01P 5/00* (2006.01)

(52) U.S. Cl.
USPC ..... 333/112; 333/109

(58) Field of Classification Search
USPC ..... 333/109, 110, 111, 112, 116, 238
See application file for complete search history.

(56) References Cited

U.S. PATENT DOCUMENTS 5,369,379 A * 11/1994 Fujiki ..... 333/116
6,972,639 B2 * 12/2005 Podell ..... 333/112

FOREIGN PATENT DOCUMENTS

JP A-2003-69316 3/2003

* cited by examiner

*Primary Examiner* — Dean O Takaoka
(74) *Attorney, Agent, or Firm* — Oliff & Berridge, PLC.

(57) ABSTRACT

According to an embodiment of the invention, a coupler has a first line that includes a coiled main line and a second line that includes a coiled secondary line arranged to oppose the main line via an insulating layer. The coupler also has a plurality of vias that connect the separate portions of the first line arranged in the different layers and connect the separate portions of the second line arranged in the different layers, and a plurality of terminals each connected to an end of the first and second lines. The vias include an extension via connected to the main line or the secondary line that extends through the insulating layer, and the extension via wires the first line and the second line to the same side of the insulating layer.

12 Claims, 19 Drawing Sheets

COUPLER

CROSS-REFERENCES TO RELATED APPLICATIONS

The present application relates to and claims priority from Japanese Patent Application Nos. 2009-272227 and 2009-272231, both filed on Nov. 30, 2009, the entire disclosure of which is incorporated herein by reference.

BACKGROUND

1. Field of the Invention

The present invention relates to a directional coupler (hereinafter simply referred to as a "coupler") that picks up part of an output signal, and particularly relates to a coupler formed by a thin-film formation process which is advantageous for achieving thinner products with smaller sizes.

2. Description of Related Art

Radio communication devices are constituted by various kinds of high-frequency components such as antennas, filters, RF switches, power amplifiers, couplers, baluns, etc. In general, a coupler is used for the purpose of picking up part of an output of a power amplifier and feeding it back to an input to the power amplifier so as to maintain and control a constant output gain of the power amplifier.

In recent years, there has been a demand for further thinner and smaller couplers to be used in mobile communication devices such as cellular phones and portable terminals as well as wireless LAN devices. For couplers responding to that demand, a stacked coupler is known, the stacked coupler having a layer of a main line and a layer of a secondary line arranged via an insulating layer, and electromagnetic coupling is generated between the layers (see Patent Document 1). In the stacked coupler, a plurality of vias is formed to ensure electric conductivity between the layers. In the coupler disclosed in Patent Document 1, the main line and the secondary line are each wired out to the opposite sides of the insulating layer through the vias.

Patent document 1: Japanese Unexamined Patent Publication No. 2003-069316

SUMMARY

However, there are limits to producing thinner and smaller couplers using the conventional coupler configuration where the main line and the secondary line are each wired out to the opposite sides of the insulating layer through the vias.

On the other hand, if the size of the coupler is simply reduced to obtain a thinner and smaller coupler, the lines, e.g., coils, constituting the coupler are inevitably shortened, which would decrease the coupling in the coupler. Furthermore, if the number of windings of the coil is increased to increase the coupling in the coupler, unnecessary coupling would increase as well between portions of the same line existing in the same layer, resulting in a problem of degraded directivity or isolation properties.

Accordingly, there has been a demand for couplers that are thinner and smaller in size and still satisfy the required various properties of the couplers.

The invention has been made in light of the above circumstances, and an object of the invention is to provide couplers that are thinner and smaller in size and still satisfy the required various properties of the couplers.

In order to solve the above-mentioned problems, a coupler according to an aspect of the invention has: a first line that includes a coiled main line and is constituted by separate portions arranged in different layers; a second line that includes a coiled secondary line arranged to be opposed to the main line via an insulating layer, the second line being constituted by separate portions arranged in different layers; a plurality of vias connecting the separate portions of the first line arranged in the different layers to each other and connecting the separate portions of the second line arranged in the different layers to each other; and a plurality of terminals each connected to an end of the first and second lines, wherein the vias include an extension via connected to the main line or the secondary line and extending through the insulating layer, and wherein the extension via wires out at least one of the first line and the second line to the same side of the insulating layer as the other one of the first line and the second line.

In the above configuration, since the via wires out at least one of the first line and the second line to the same side of the insulating layer as the other one of the first and the second lines, the first and second lines can share wiring layers in which the respective lines are to be formed. As a result, the number of layers in the coupler is reduced and this reduction of layers allows a thinner coupler, and such a thinner coupler has a reduced size. Since there is no need to reduce the lengths of the first and second lines in the coupler according to the invention, a thinner coupler with a reduced size can be obtained without decreasing the coupling in the coupler.

In the above configuration, the vias may include a via connected to an inner end of the main line and a via connected to an inner end of the secondary line, and all the terminals may be arranged in the periphery of the coiled main and secondary lines. By arranging the terminals in the periphery of the main and secondary lines, a certain distance can be ensured between the terminals and the vias connected to the inner ends of the main and secondary lines, and as a result, unnecessary coupling between the vias and the terminals can be suppressed.

The vias may include a prismatic via having corners in its cross-section (having a rectangular cross-section) parallel to the insulating layer, and the prismatic via may be arranged such that the corners face the terminals in the cross-section parallel to the insulating layer. As a result, the sides of the vias and the sides of the terminals are not parallel to one another, and thus, unnecessary coupling between the vias and the terminals can be suppressed.

The vias may include a cylindrical via having a circular portion in its cross-section (having a circular cross-section) parallel to the insulating layer. Since the cylindrical via has no side to be parallel to the sides of the other vias or the terminals, unnecessary coupling between the cylindrical via and the other vias or the terminals can be suppressed.

The terminals may include four terminals, and the vias may be arranged such that at least one of the vias is at the center of the four terminals. Since the via arranged at the center of the four terminals has a certain distance from all the four terminals, coupling between that via and the terminals can be effectively reduced.

In order to solve the above-mentioned problems, according to another aspect of the invention, provided is a coupler having: a first line including a main line and a first connecting wiring; and a second line including a secondary line and a second connecting wiring, wherein the main line and the secondary line are arranged in different layers via an insulating layer such that electromagnetic coupling is generated between the main line and the secondary line, and wherein at least one of the first connecting wiring and the second connecting wiring is arranged in the same layer as the first line or the second line such that electromagnetic coupling between the first line and the second line is generated in the same layer.

In the above configuration, since electromagnetic coupling between the first line and the second line is generated not only in different layers but also within the same layer, increased coupling can be obtained. Accordingly, the coupling in the coupler can be increased while suppressing degradation of directivity or isolation properties. As a result, thinner couplers with reduced sizes can be achieved while maintaining various properties of the couplers.

In the above, at least part of the first connecting wiring and at least part of the second line may be arranged adjacently to each other in the same layer. Also, at least part of the first connecting wiring and at least part of the secondary line may be arranged adjacently to each other in the same layer. Also, at least part of the second connecting wiring and at least part of the main line may be arranged adjacently to each other in the same layer.

It is preferable that portions of one wiring which intersect with each other in a plan view are arranged to be orthogonal to each other at the intersection. With this configuration, unnecessary coupling, such as coupling between portions of the first line or coupling between portions of the second line, can be avoided, and thus, degradation of directivity or isolation properties can be suppressed.

It is preferable that the above coupler further has a via connected to the main line or the secondary line and extending through the insulating layer, the via wiring out at least one the first line and the second line to the same side of the insulating layer as the other one of the first and second lines. In the above, the coupler of the invention may have: a first layer including at least the main line; a second layer including at least the secondary line; and a third layer including at least part of the first connecting wiring and/or the second connecting wiring. By wiring out, using the via, at least one of the first line and the second line to the same side of the insulating layer as the other one of the first and second lines, the first line and the second line can share wiring layers in which the respective lines are to be formed, and thus, the number of layers in the coupler can be reduced, which contributes to producing a thinner coupler.

DETAILED DESCRIPTION OF PREFERRED EMBODIMENTS

Figure 1:
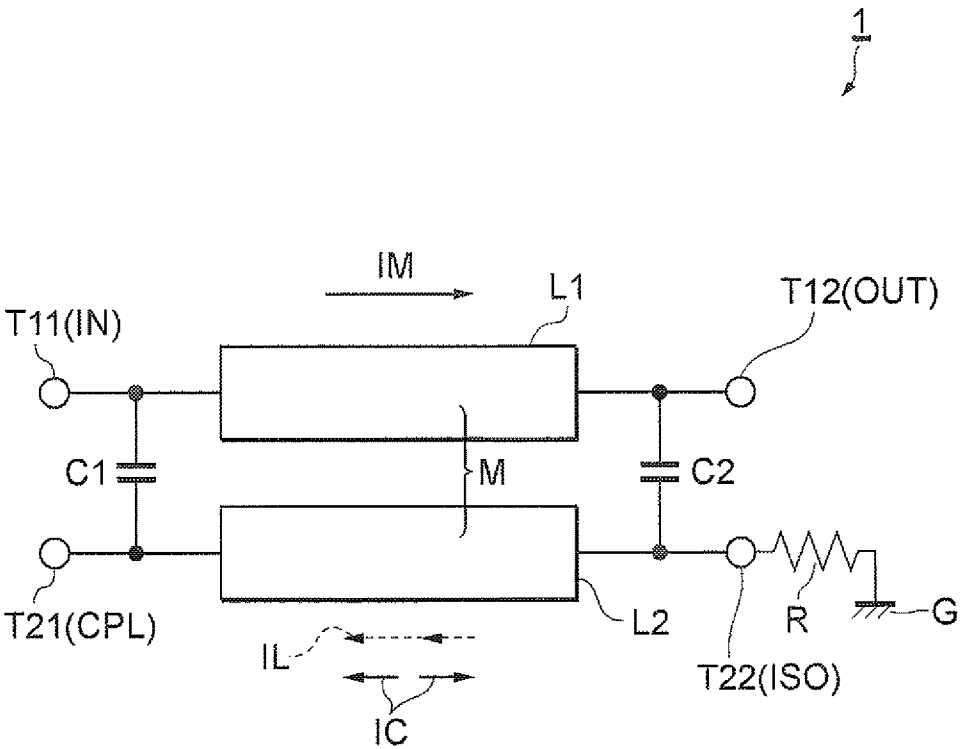
FIG. 1 is an equivalent circuit diagram showing the configuration of a coupler according to an embodiment of the invention.

Embodiments of the invention will be described below with reference to the attached drawings. In the drawings, the same components are given the same reference numerals, and any repetitive description will be omitted. The positional relationship, such as top and bottom, left and right, etc., is as shown in the drawings unless otherwise specified. The dimensional ratios are not limited to those shown in the drawings. The below embodiments are just examples for describing the invention, and the invention is not limited to those embodiments. The invention can be modified in various ways without departing from the gist of the invention.

FIG. 1 is an equivalent circuit diagram showing the configuration of a coupler according to an embodiment of the invention. A coupler 1 has a first line L1 and a second line L2 which is electromagnetically coupled with the first line L1. In FIG. 1, a magnetic coupling M and capacitive couplings C1 and C2 are illustrated as the electromagnetic coupling between the first line L1 and the second line L2.

In the coupler 1, one end of the first line L1 is connected to an input terminal T11 and the other end of the first line L1 is connected to an output terminal T12. Also, one end of the second line L2 is connected to a coupling terminal T21 and the other end of the second line L2 is connected to an isolation terminal T22. The isolation terminal T22 is fixed to a grounding potential G via resistance R.

The length of the lines L1 and L2 may be different according to the specification of the coupler 1. For example, the length may be set so that the coupler 1 serves as a quarter-wavelength ($\lambda/4$) resonator circuit for signals to be transmitted.

Referring to FIG. 1, the basic operation of the coupler 1 will be described below. Signals are input to the input terminal T11 and output from the output terminal T12. When a signal is input to the input terminal T11, a principal current IM flows through the first line L1. The principal current IM in the first line L1 makes an induced current IL due to the magnetic coupling M flow through the second line L2 in one direction, and also makes a displacement current IC due to the capacitive couplings C1 and C2 flow through the second line L2 in the two opposite directions. The resulting current flowing in the second line L2 will be the sum of the induced current IL due to the magnetic coupling M and the displacement current IC due to the capacitive couplings C1 and C2, and as a result, the current having directivity corresponding to the direction of the induced current caused by the magnetic coupling will flow toward the coupling terminal T21. As described above, when a signal is input to the input terminal T11 of the coupler and output from the output terminal T12, a signal corresponding to part of the above signal is output from the coupling terminal T21.

The above-described coupler 1 is used, for example, for an output monitor of a power amplifier (PA). In such use, the input terminal T11 of the coupler 1 is connected to an output terminal of the power amplifier, and the coupling terminal T21 of the coupler 1 is connected to an input terminal of the power amplifier via an AGC detection circuit. With this configuration, when a signal is output from the power amplifier and input to the input terminal T11 of the coupler 1, a signal corresponding to part of that signal is output from the coupling terminal T21 of the coupler 1 and input to the power amplifier as a feedback signal through the AGC detection circuit. Thus, the power amplifier can maintain and control a constant output gain.

Figure 2:
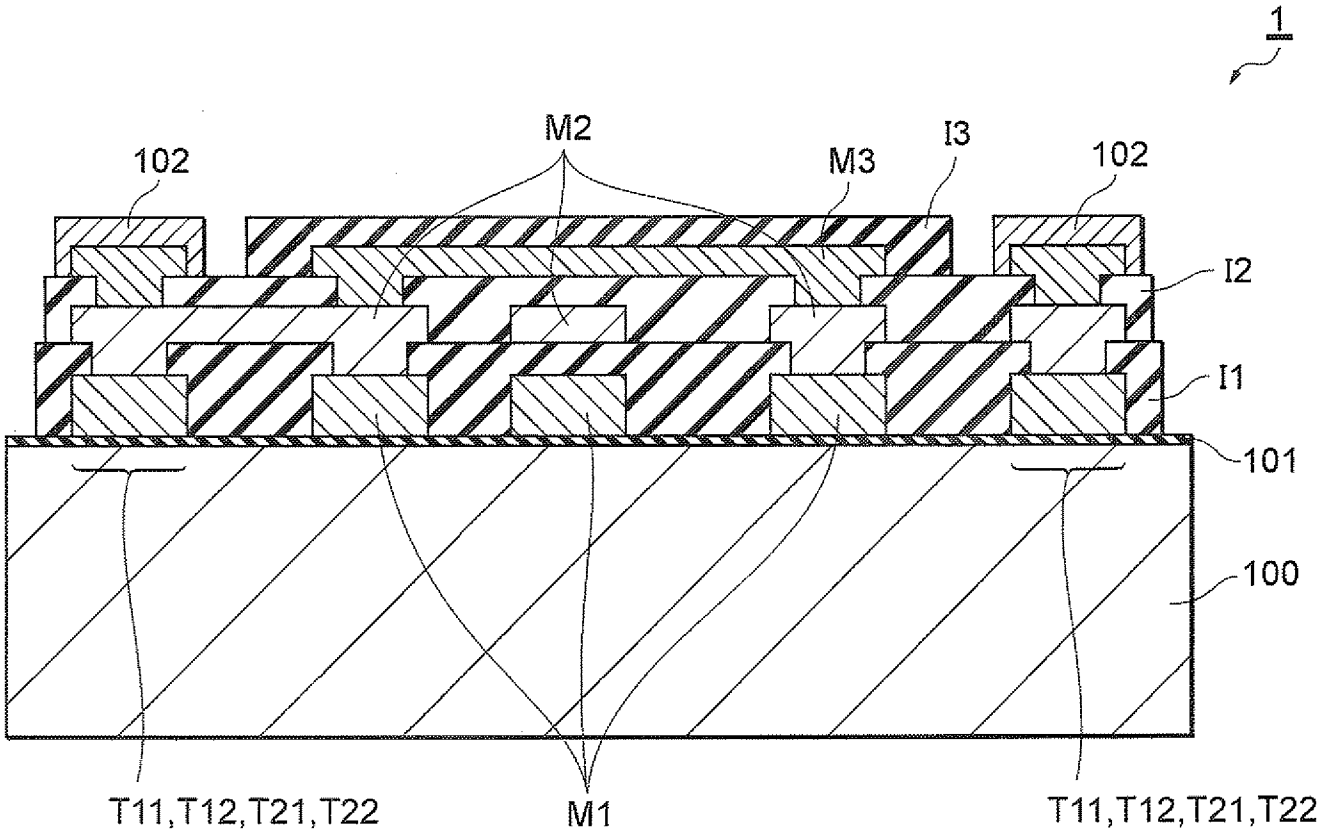
FIG. 2 is a vertical sectional view showing the configuration of a coupler according to an embodiment of the invention.

Next, the wiring configuration of the above-described coupler according to an embodiment of the invention will be described. FIG. 2 is a vertical sectional view of the coupler 1, schematically illustrating the wiring configuration of the coupler 1. As shown in FIG. 2, a wiring layer M1 is formed on an insulating substrate 100 which is formed of, for example, alumina, via an insulating layer 101 formed of, for example, a silicon nitride film. Also, a wiring layer M2 is formed on the wiring layer M1 via an insulating layer I1, a wiring layer M3 is formed on the wiring layer M2 via an insulating layer I2, and a passivation layer I3 is formed on the wiring layer M3. The insulating layers I1 and I2 have vias formed therein so as to have the necessary connections between the wiring layers M1, M2 and M3. In the peripheral portion of the coupler, the stacked wiring layers M1, M2 and M3 form terminals T11, T12, T21 and 122. The passivation layer I3 is formed such that the terminals T11, T12, T21 and T22 are exposed, and a plating film 102 is formed on the surface of the terminals T11, T12, T21 and T22.

For the insulating layers I1 and I2 and the passivation layer I3, for example, inorganic insulators such as silicon nitride, aluminum oxide and silicon dioxide may be used, and organic insulators such as polyimide and epoxy resin may be used as well. Also, for the wiring layers M1, M2 and M3, for example, Cu, Ag, Pd, Ag—Pd, Ni, Au, etc., may be used. The wiring layers M1-M3 may be formed, for example, by sputtering, deposition, printing, or photolithography. For the plating film 102, for example, Ni/Au plating or Ni/Sn plating may be used. As described above, the coupler 1 is constituted by a thin-film multilayer configuration formed on the insulating substrate 100.

Embodiment 1

Next, one example of the respective patterns of the wiring layers M1, M2 and M3 in a coupler of Embodiment 1 will be described in detail. In the below embodiment, coils are used for the main line and the secondary line which constitute the lines L1 and L2 respectively.

FIGS. 3-8 are horizontal sectional views schematically illustrating the respective layers M1-M3 and I1-I3 of the coupler 1. As illustrated in FIGS. 3-8, the input terminal T11, the output terminal T12, the coupling terminal T21, and the isolation terminal T22 are formed in all the wiring layers M1-M3, and the portions of the terminals T11, T12, T21 and T22 formed in one layer are electrically connected to the corresponding portions in a different layer. The following is a detailed explanation of the configuration of each layer.

Figure 3:
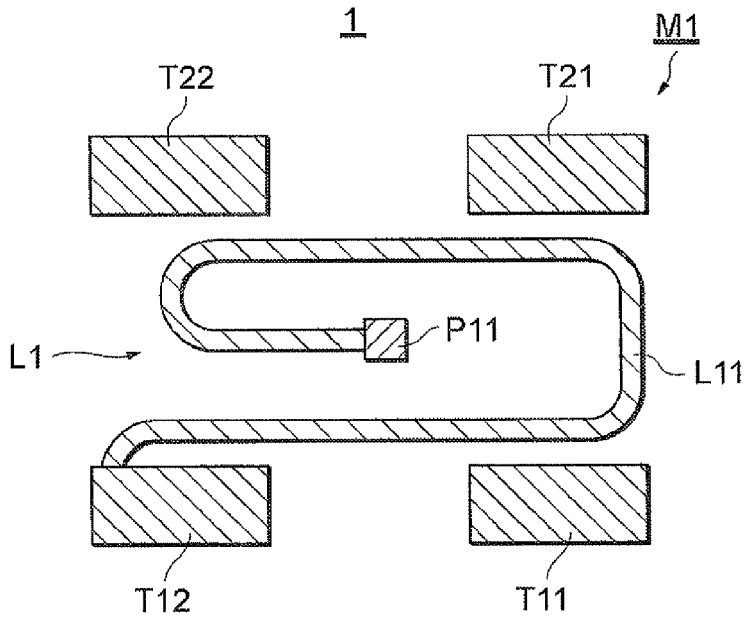
FIG. 3 is a horizontal sectional view of a wiring layer M1 of a coupler 1.

Referring to FIG. 3, in the wiring layer M1 formed on the insulating substrate 100 (via the insulating film 101), the coiled first line L1 is formed. In the wiring layer M1, the outer end of the coiled first line L1 is connected to the output terminal T12 and the inner end of the first line L1 is connected to a via P11 (extension via). The via P11 extends from the wiring layer M1 to the wiring layer M3 through the insulating layers I1 and I2. The via P11 is formed in a prism shape, having corners in its cross-section parallel to the substrate (such cross-section being parallel to the insulating layers as well). In the first line L1 in the wiring layer M1, the portion that is opposed to the second line L2 in the wiring layer M2, which will be explained later, serves as a main line L11. The main line indicates a portion of the first line L1, the portion creating electromagnetic coupling with the second line formed in a different layer.

Figure 4:
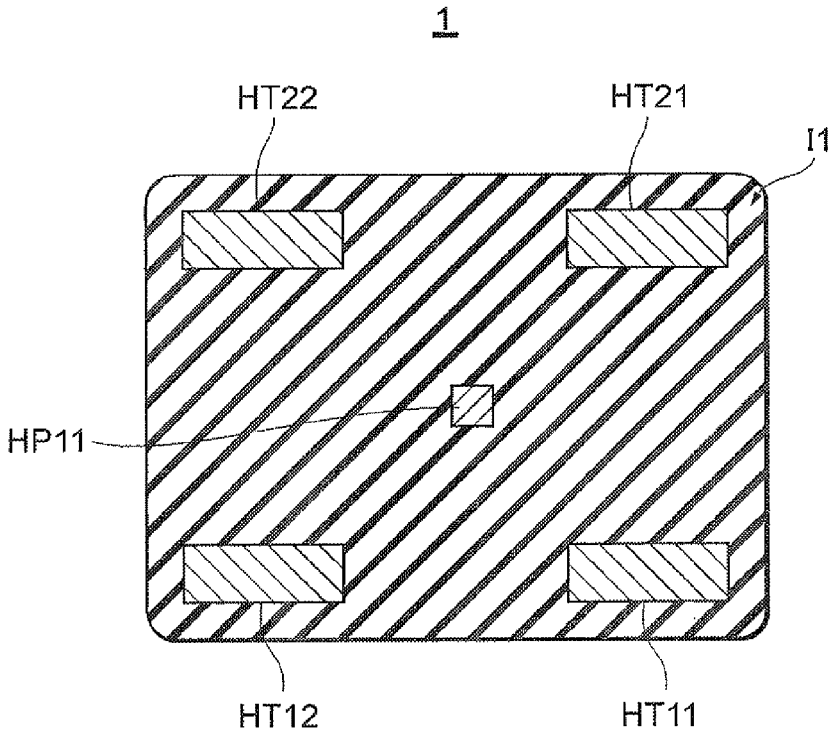
FIG. 4 is a horizontal sectional view of an insulating layer I1 of the coupler 1.

Referring next to FIG. 4, in the insulating layer I1 formed on the wiring layer M1, through holes Hill, HT12, HT21 and H122 are formed at portions corresponding to the respective terminals T11, T12, T21 and T22. Also formed in the insulating layer I1 is a through hole HP11, which is formed at a portion corresponding to the via P11. Herein, a through hole refers to an opening (hole) formed in an insulating layer, and a via refers to a conductor formed by putting metal into such a through hole.

Figure 5:
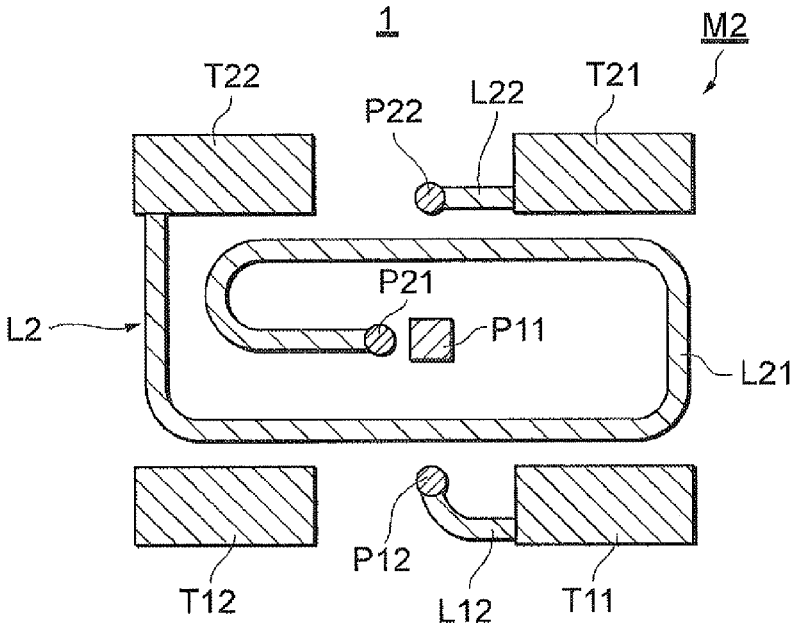
FIG. 5 is a horizontal sectional view of a wiring layer M2 of the coupler 1.

Referring next to FIG. 5, in the wiring layer M2 formed on the insulating layer I1, the coiled second line L2 is formed. In the wiring layer M2, the outer end of the coiled second line L2 is connected to the isolation terminal T22, and the inner end of the second line L2 is connected to a via P21. The via P21 extends from the wiring layer M2 to the wiring layer M3 through the insulating layer I2. A portion of the second line L2 in the wiring layer M2 is opposed to the first line L1 in the wiring layer M1, and the opposed portion serves as a secondary line L21. The secondary line indicates a portion of the second line L2, the portion creating electromagnetic coupling with the first line L1 formed in a different layer. Also, connecting wirings L12 and L22 are formed around (in the periphery of) the secondary line L21. The connecting wiring L12 is a portion of the first line L1, and one end thereof is connected to the input terminal T11 and the other end is connected to a via P12. The via P12 extends through the insulating layer I2 to the wiring layer M3. The connecting wiring L22 is a portion of the second line L2, and one end thereof is connected to the coupling terminal T21 and the other end is connected to a via P22. The via P22 extends through the insulating layer I2 to the wiring layer M3. The vias P12, P21 and P22 are, for example, cylindrical vias having a circular shape in a cross-section parallel to the substrate (such cross-section being parallel to the insulating layers as well).

Figure 6:
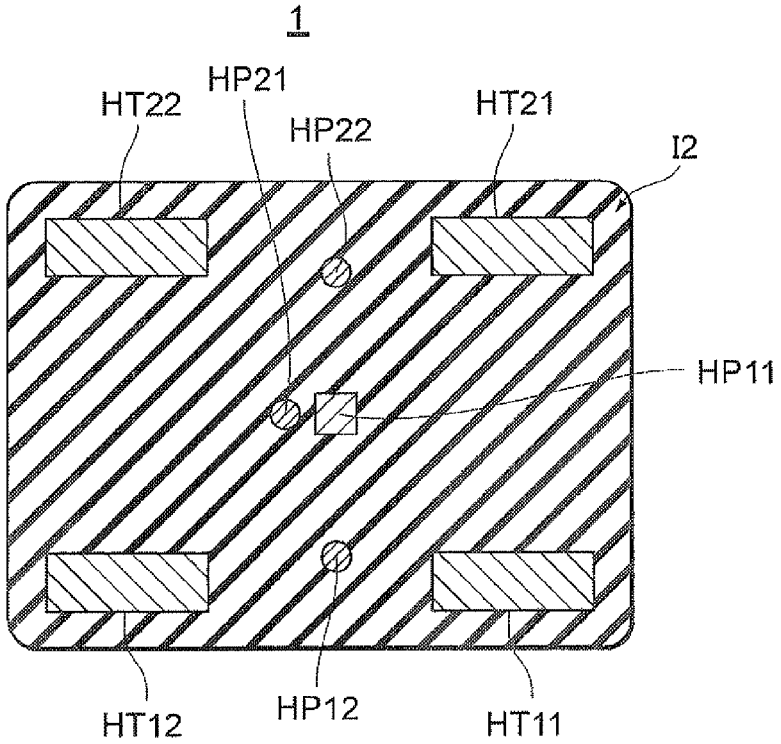
FIG. 6 is a horizontal sectional view of an insulating layer I2 of the coupler 1.

Referring next to FIG. 6, in the insulating layer I2 formed on the wiring layer M2, the through holes HT11, HT12, HT21 and HT22 are formed at portions corresponding to the respective terminals T11, T12, T21 and T22. Through holes HP11, HP12, HP21 and HP22 are also formed in the insulating layer I2 at portions corresponding to the vias P11, P12, P21 and P22.

Figure 7:
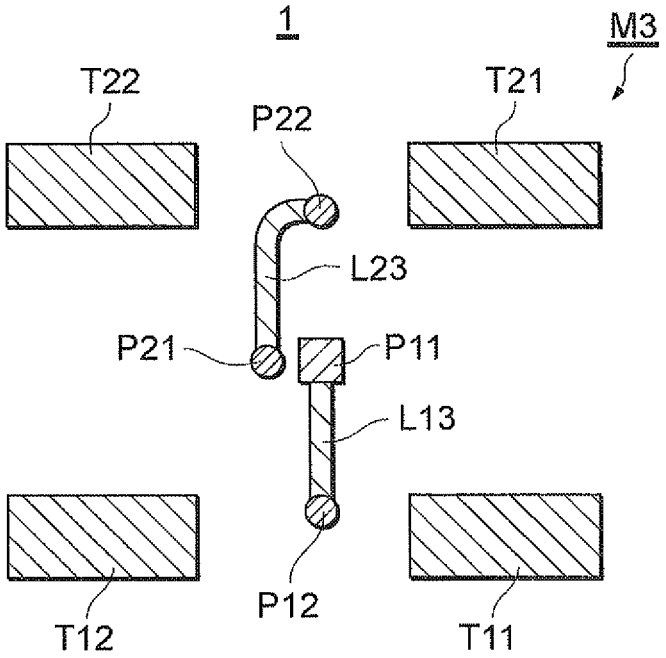
FIG. 7 is a horizontal sectional view of a wiring layer M3 of the coupler 1.

Referring next to FIG. 7, in the wiring layer M3 formed on the insulating layer I2, connecting wirings L13 and L23 are formed. The connecting wiring L13 is a portion of the first line L1, and one end thereof is connected to the via P11 and the other end is connected to the via P12. The connecting wiring L23 is a portion of the second line L2, and one end thereof is connected to the via P21 and the other end is connected to the via P22.

Figure 8:
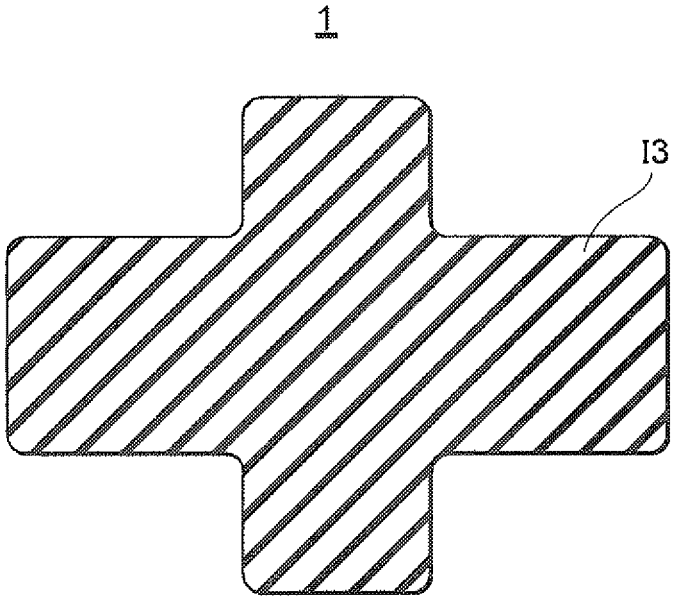
FIG. 8 is a horizontal sectional view of a passivation layer I3 of the coupler 1.

Referring next to FIG. 8, the passivation layer I3 is formed on the wiring layer M3. The passivation layer I3 is formed at portions excluding four corners where the terminals T11, T12, T21 and T22 are formed.

Figure 9:
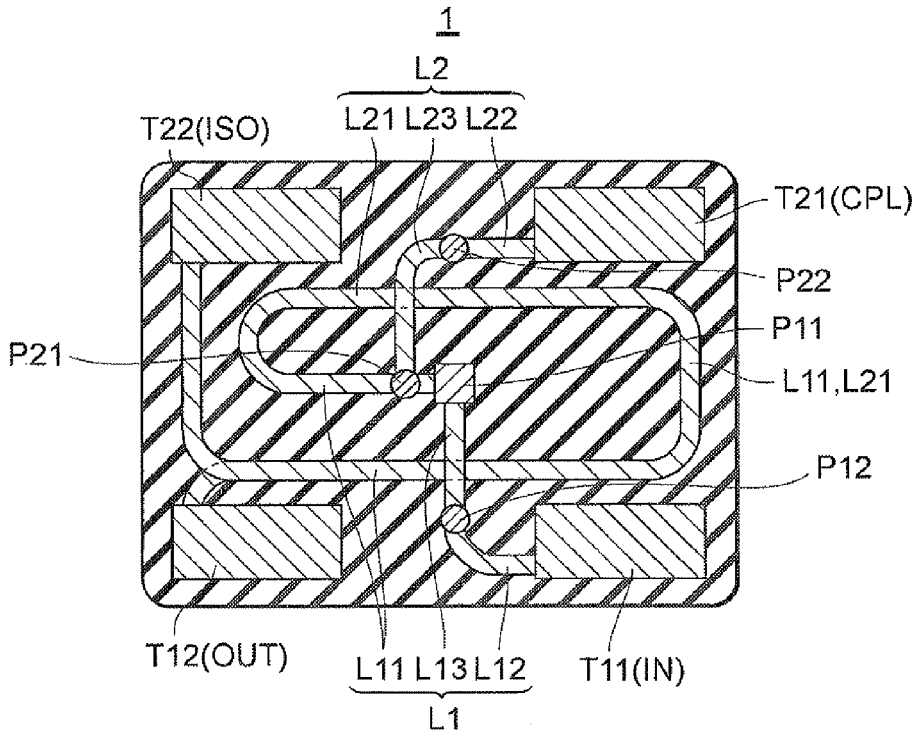
FIG. 9 is a plan view illustrating a wiring layout of the coupler 1.

FIG. 9 is a plan view showing the wiring layout of the coupler 1. As shown in FIG. 9, the coupler 1 has: the first line L1 including the main line L11 and the connecting wirings L12 and L13 (first connecting wiring); and the second line L2 including the secondary line L21 and the connecting wirings L22 and L23 (second connecting wiring). As can be seen from FIGS. 3 and 5, the main line L11 and the secondary line L12 are arranged in different layers so that they overlap in a plan view, and accordingly, electromagnetic coupling is created between the different layers through the insulating layer I1.

In this embodiment, the via P11 connected to the main line L11 is formed to extend through the insulating layer I1. By forming the via P11 to wire out the first line L1 to the wiring layer M2 where the second line L2 is formed, the first line L1 and the second line L2 can share wiring layers in which the respective lines are to be formed. Consequently, the number of layers in the coupler can be reduced, and this reduction of layers allows a thinner coupler, resulting in a coupler with a reduced size. In this embodiment, since a thinner and smaller coupler can be achieved without reducing the length of the first line L1 or the second line L2, such a coupler does not cause disadvantages such as decrease of coupling. In addition, since there is no need to reduce the thickness of the interlayer insulating layers, coupling between portions of the first line and coupling between portions of the second line can be suppressed and degradation of isolation properties can be suppressed as well.

In this embodiment, as shown in FIG. 9, the connecting wiring L12 of the first line L1 is located in the same layer as, and adjacently and parallel to, the secondary line L21 of the second line L2. This is to ensure that electromagnetic coupling between the first line L1 and the second line L2 is generated in the same layer. In order to increase electromagnetic coupling, two wirings should be located, at least, adjacently, and preferably parallel, to each other. With this configuration, the coupling in the coupler can be increased without increasing the number of windings of the first line L1 or the second line L2, and thus, the coupling in the coupler can be increased while suppressing degradation of directivity or isolation properties. As a result, thinner couplers with reduced sizes can be achieved while maintaining various properties of the couplers.

Also, in this embodiment, when portions of the same wiring intersect with each other in a plan view, the portions are arranged to be orthogonal to each other at the intersection. In other words, the intersecting portions of the first line, and the intersecting portions of the second line, are arranged to be orthogonal to each other. For example, in FIG. 9, at the intersection of the connecting wiring L13 and the main line 11, and at the intersection of the connecting wiring L23 and the secondary line L21, the two wirings are arranged to be orthogonal to each other. Electromagnetic coupling between the wirings through which the same current flows is normally unnecessary, and by avoiding such unnecessary coupling, degradation of directivity or isolation properties can be suppressed.

In this embodiment, the first line L1 is wired out, using the via P11, to the wiring layer M2 where the second line L2 is formed, and the first line L1 and the second line L2 can consequently share the wiring layers in which the respective lines are to be formed. Accordingly, the number of vias extending through the insulating layer is twice the number of vias in the conventional configurations where each line is wired out to the opposite sides, and thus, coupling between the vias and coupling between the vias and terminals should desirably be reduced to suppress degradation of isolation properties. A suitable shape and arrangement of the vias for reducing coupling between the vias and between the vias and the terminals will be described below.

Figure 10:
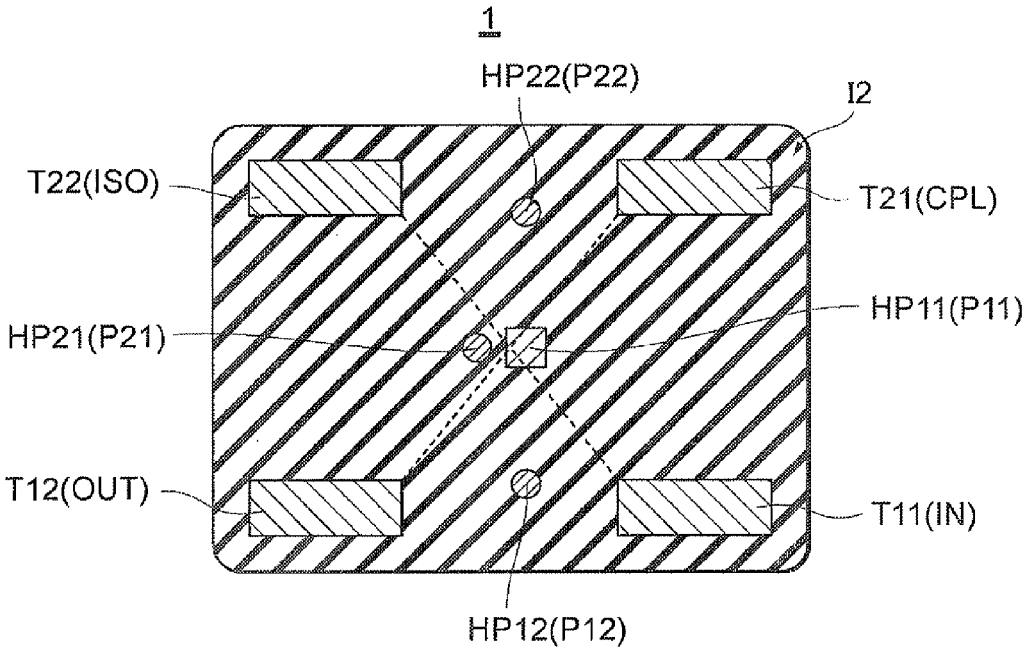
FIG. 10 is a horizontal sectional view of the insulating layer I2, showing a suitable arrangement of vias.

FIG. 10 is a horizontal sectional view of the insulating layer I2, showing a suitable arrangement of the vias. The arrangement and shapes of the vias correspond to the arrangement and shapes of the through holes formed in the insulating layer I2, so the arrangement and shapes of the vias will be described referring to FIG. 10.

The four terminals T11, T12, T21 and T22 are formed in the four corners of the substrate. The four terminals extend in the stacking direction of the respective layers on the substrate, and this direction is the same as the extending direction of the via P11 and the via P21. A prismatic via having corners in its cross-section parallel to the substrate surface is used for the via P11, and in this embodiment, the cross-sectional shape is a rectangle. Also, the via P11 is arranged such that the corners of the via P11 in a cross-section parallel to the insulating layers face the respective terminals. The corners of the via P11 preferably face the corners of the respective terminals T11, T12, T21 and T22. With this arrangement, the sides of the via are not positioned parallel to the sides of the terminals, and thus, unnecessary electromagnetic coupling between the via and the terminals can be suppressed, which results in improved isolation properties. Prismatic vias arranged in the above manner are suitable for vias through which a large current flows. Normally, a large principal current flows through the first line of the coupler, and thus, in order to reduce electromagnetic coupling between the via and the terminals, a prismatic via is used in this embodiment for the via P11 that connects portions of the first line L1. Note, however, that the arrangement and shape are not limited to the above.

In this embodiment, the via P11, which is the longest via, has a larger cross-sectional area than the other vias P12, P21 and P22. When forming the via P11, a long through hole HP11 extending through the two insulating layers I1 and I2 needs to be formed by lithography and etching. Since the aspect ratio of the through hole has limits, a longer through hole should preferably have a larger width, and when the width of the through hole HP11 is increased, the cross-sectional area of the via P11 is increased as well. By configuring the long via P11 to have a larger cross-sectional area than the other vias P12, P21 and P22, the connection reliability of the via P11 can be improved.

Furthermore, in this embodiment, the widest via P11 (having the largest cross-sectional area) is arranged at the center of the four terminals T11, T12, T21 and T22. Since the four terminals T11, T12, T21 and T22 in this embodiment are arranged at the four corners of the rectangle, the center thereof means the intersection of a virtual diagonal line connecting the terminals T11 and T22 and another virtual diagonal line connecting the terminals T12 and T21 (see the dotted lines in FIG. 10). By positioning the widest via P11 at the center of the four terminals, the via P11 can have a certain distance from all the terminals, and accordingly, unnecessary electromagnetic coupling between the terminals and the via can effectively be reduced, resulting in improved isolation properties.

Furthermore, in this embodiment, the via P21, which is a cylindrical via having a circular shape in its cross-section parallel to the substrate surface, is arranged in the center portion adjacent to the via P11. The circular cross-section of the via P21 results in the via P21 having no side parallel to the side of the via P11, which can suppress electromagnetic coupling between the via P11 and the via P21. In addition, the cylindrical via P21 does not have any side parallel to any of the sides of the four surrounding terminals T11, T12, T21 and T22, and thus, electromagnetic coupling between the via and the terminals can be suppressed, resulting in improved isolation properties.

Still furthermore, in this embodiment, the other two vias P12 and P22 are arranged such that, when seen in the plan view of FIG. 10, the via P12 is placed between the lower two terminals T11 and T12 while the via P22 is placed between the upper two terminal T21 and T22. Accordingly, the space between the vias and the space between the vias and the terminals can be well balanced, and unnecessary electromagnetic coupling can thus be reduced. In addition, by using a cylindrical via for both of the vias P12 and P22, the vias P12 and P22 do not have any side parallel to any of the sides of the other vias P11 and P21 or the sides of the terminals T11,112, T21 and T22, and thus, unnecessary electromagnetic coupling can be suppressed, resulting in improved isolation properties.

Embodiment 1A

Next, the respective patterns of the wiring layers M1, M2 and M3 in a coupler according to Embodiment 1A will be described in detail. FIGS. 11-16 are horizontal sectional views schematically illustrating the respective layers M1-M3 and I1-I3 of a coupler 1A. As illustrated in FIGS. 11-16, the input terminal T11, the output terminal T12, the coupling terminal T21, and the isolation terminal T22 are formed in all the wiring layers M1-M3, and the portions of the terminals T11, T12, T21 and T22 formed in one layer are electrically connected to the corresponding portions in a different layer. The following is a detailed explanation of the configuration of each layer.

Figure 11:
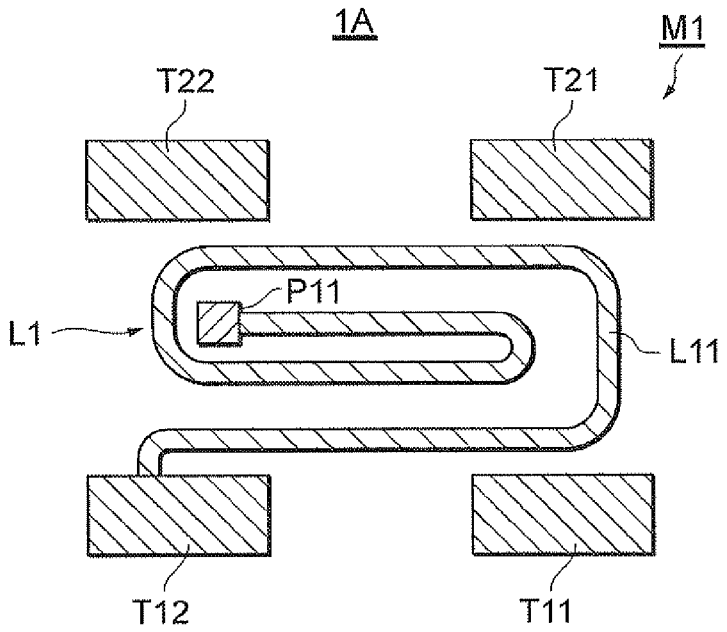
FIG. 11 is a horizontal sectional view of a wiring layer M1 of a coupler 1A.

Referring to FIG. 11, in the wiring layer M1 formed on the insulating substrate 100 (via the insulating film 101), the coiled first line L1 is formed. In the wiring layer M1, the outer end of the coiled first line L1 is connected to the output terminal T12, and the inner end of the first line L1 is connected to the via P11. The via P11 extends from the wiring layer M1 to the wiring layer M3 through the insulating layers I1 and I2. In the first line L1 in the wiring layer M1, the portion that is opposed to the second line L2 in the wiring layer M2, which will be explained later, serves as the main line L11. The main line indicates a portion of the first line L1, the portion creating electromagnetic coupling with the second line formed in a different layer.

Figure 12:
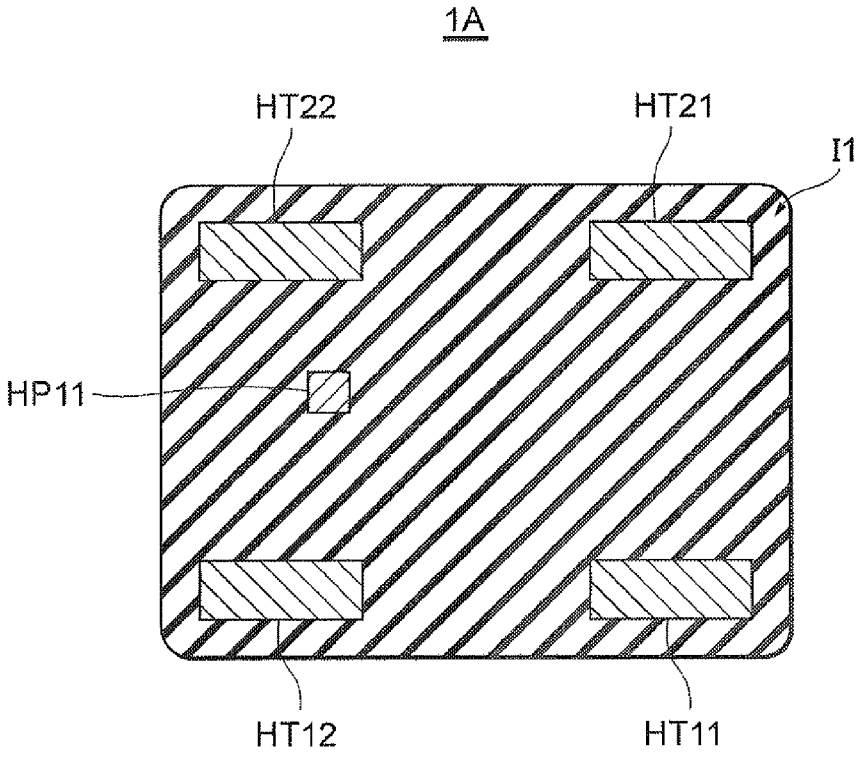
FIG. 12 is a horizontal sectional view of an insulating layer I1 of the coupler 1A.

Referring next to FIG. 12, in the insulating layer I1 formed on the wiring layer M1, the through holes HT11, HT12, HT21 and HT22 are formed at portions corresponding to the respective terminals T11, T12, T21 and T22. Also formed in the insulating layer I1 is the through hole HP11, which is formed at a portion corresponding to the via P11. Herein, a through hole refers to an opening (hole) formed in an insulating layer, and a via refers to a conductor formed by putting metal into such a through hole.

Figure 13:
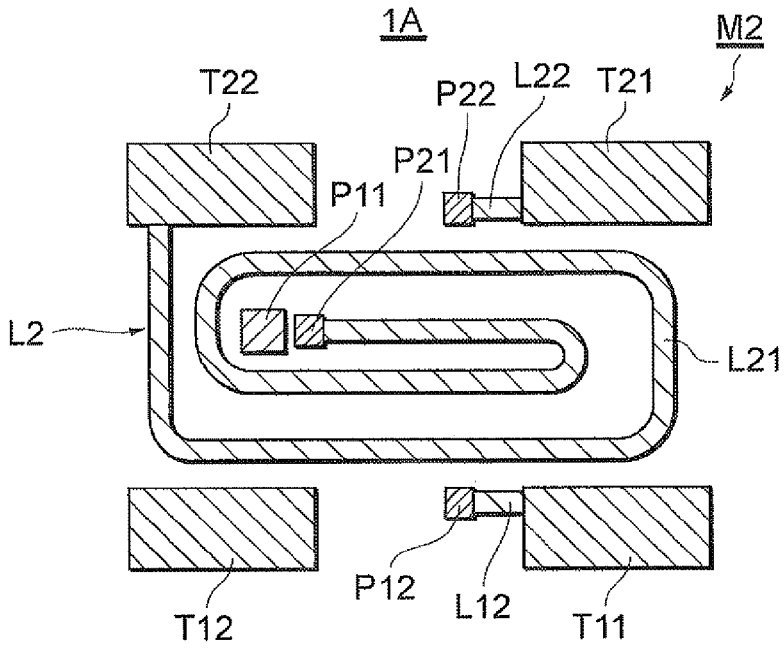
FIG. 13 is a horizontal sectional view of a wiring layer M2 of the coupler 1A.

Referring next to FIG. 13, in the wiring layer M2 formed on the insulating layer I1, the coiled second line L2 is formed. In the wiring layer M2, the outer end of the coiled second line L2 is connected to the isolation terminal T22, and the inner end of the second line L2 is connected to the via P21. The via P21 extends from the wiring layer M2 to the wiring layer M3 through the insulating layer I2. A portion of the second line L2 in the wiring layer M2 is opposed to the first line L1 in the wiring layer M1, and the opposed portion serves as the secondary line L21. The secondary line indicates a portion of the second line L2, the portion creating electromagnetic coupling with the first line L1 formed in a different layer. Also, the connecting wirings L12 and L22 are formed around the secondary line L21. The connecting wiring L12 is a portion of the first line L1, and one end thereof is connected to the input terminal T11 and the other end is connected to the via P12. The via P12 extends through the insulating layer I2 to the wiring layer M3. The connecting wiring L22 is a portion of the second line L2, and one end thereof is connected to the coupling terminal T21 and the other end is connected to the via P22. The via P22 extends through the insulating layer I2 to the wiring layer M3.

Figure 14:
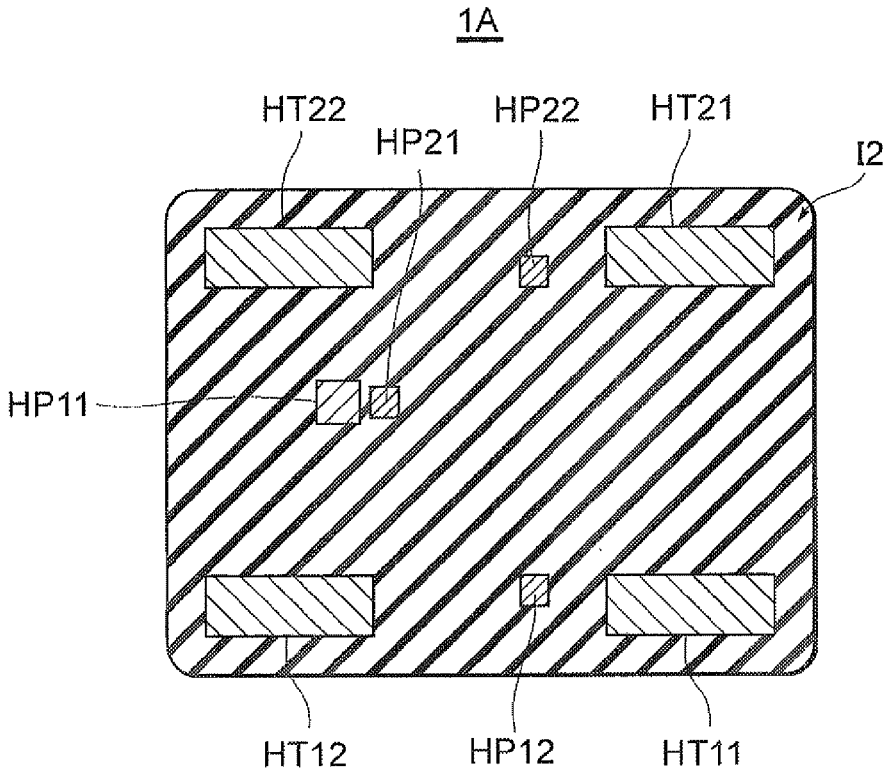
FIG. 14 is a horizontal sectional view of an insulating layer I2 of the coupler 1A.

Referring next to FIG. 14, in the insulating layer I2 formed on the wiring layer M2, the through holes HT11, HT12, HT21 and HT22 are formed at portions corresponding to the respective terminals T11, T12, T21 and T22. The through holes HP11, HP12, HP21 and HP22 are also formed in the insulating layer I2 at portions corresponding to the vias P11, P12, P21 and P22.

Figure 15:
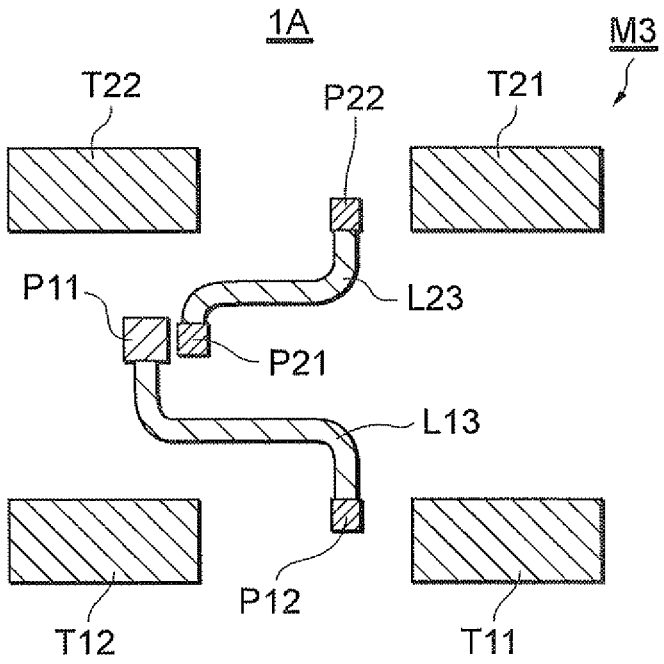
FIG. 15 is a horizontal sectional view of a wiring layer M3 of the coupler 1A.

Referring next to FIG. 15, in the wiring layer M3 formed on the insulating layer I2, the connecting wirings L13 and L23 are formed. The connecting wiring L13 is a portion of the first line L1, and one end thereof is connected to the via P11 and the other end is connected to the via P12. The connecting wiring L23 is a portion of the second line L2, and one end thereof is connected to the via P21 and the other end is connected to the via P22.

Figure 16:
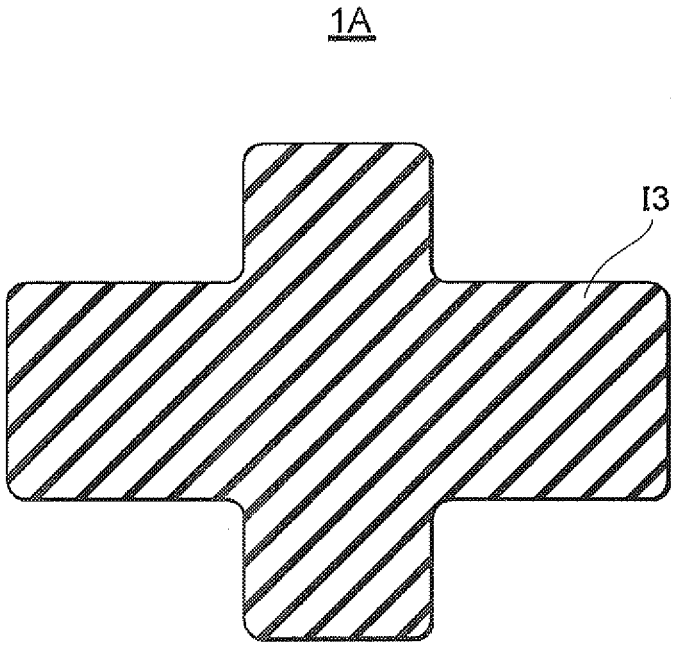
FIG. 16 is a horizontal sectional view of a passivation layer I3 of the coupler 1A.

Referring next to FIG. 16, the passivation layer I3 is formed on the wiring layer M3. The passivation layer I3 is formed at portions excluding four corners where the terminals T11, T12, T21 and T22 are formed.

Figure 17:
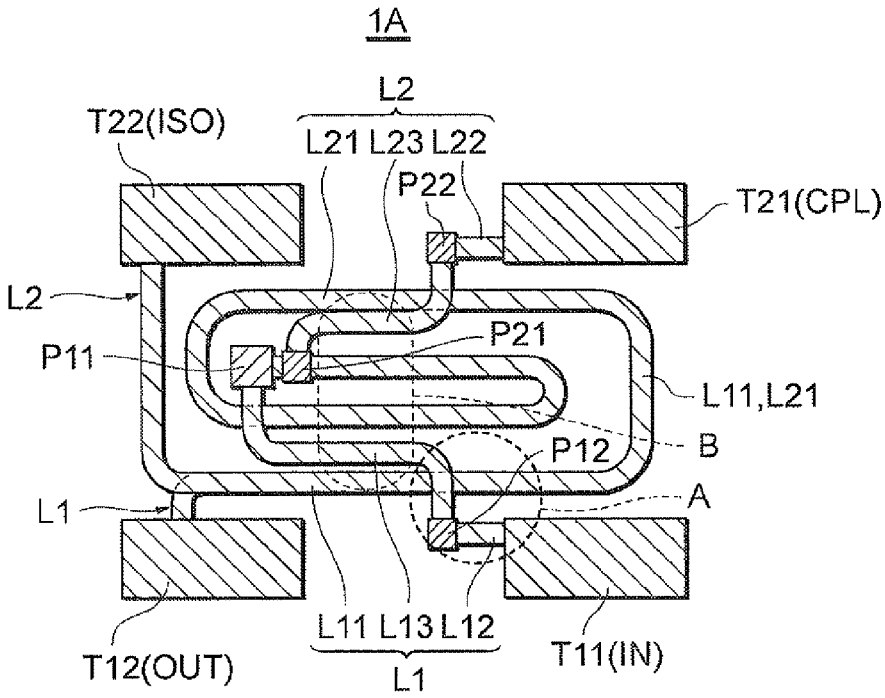
FIG. 17 is a plan view illustrating a wiring layout of the coupler 1A.

FIG. 17 is a plan view showing the wiring layout of the coupler 1A. As shown in FIG. 17, the coupler 1A has: the first line L1 including the main line L11 and the connecting wirings L12 and L13 (first connecting wiring); and the second line L2 including the secondary line L21 and the connecting wirings L22 and L23 (second connecting wiring). As can be seen from FIGS. 11 and 13, the main line L11 and the secondary line L12 are arranged in different layers so that electromagnetic coupling is generated between the different layers through the insulating layer I1.

As can be seen from dotted line A in FIGS. 13 and 17, the connecting wiring L12 of the first line L1 is located in the same layer as, and adjacently and parallel to, the secondary line L21 of the second line L2, and as a result, electromagnetic coupling between the first line L1 and the second line L2 in the same layer is ensured. In order to increase electromagnetic coupling, two wirings should be located, at least, adjacently, and preferably parallel, to each other. With this configuration, the coupling in the coupler can be increased without increasing the number of windings of the first line L1 or the second line L2, and thus, the coupling in the coupler can be increased while suppressing degradation of directivity or isolation properties. As a result, thinner couplers with reduced sizes can be achieved while maintaining various properties of the couplers.

Also, as can be seen from dotted line B in FIG. 17, a part of the connecting wiring L13 of the first line L1 is located in the same layer as, and adjacently and parallel to, a part of the connecting wiring L23 of the second line L2, and as a result, electromagnetic coupling between the first line L1 and the second line L2 in the same layer is ensured. With this configuration, the coupling in the coupler can further be increased.

Also, in this embodiment, when portions of the same wiring intersect with each other in a plan view, the portions are arranged to be orthogonal to each other at the intersection. In other words, the intersecting portions of the first line and the intersecting portions of the second line are arranged to be orthogonal to each other. For example, in FIG. 17, at the (two) intersections of the connecting wiring L13 and the main line 11, and at the intersection of the connecting wiring L23 and the secondary line L21, the two wirings are arranged to be orthogonal to each other. Electromagnetic coupling between the wirings through which the same current flows is normally unnecessary, and by avoiding such unnecessary coupling, degradation of directivity or isolation properties can be suppressed.

Also, in this embodiment, the via P11 connected to the main line L11 is formed to extend through the insulating layer I1. By forming the via P11 to wire out the first line L1 to the wiring layer M2 where the second line L2 is formed, the first line L1 and the second line L2 can share wiring layers in which the respective lines are to be formed. Consequently, the number of layers in the coupler can be reduced and this reduction contributes to a thinner coupler.

Embodiment 1B

Next, the configuration of a coupler according to Embodiment 1B will be described. FIGS. 18-22 are horizontal sectional views schematically illustrating the respective layers M1-M3 and I1-I2 of a coupler 1B. The pattern of the passivation layer I3 of Embodiment 1B is the same as that of Embodiment 1A. Also, as with Embodiment 1, the terminals T11,T12,T21 and T22 are formed in all the wiring layers M1-M3.

Figure 18:
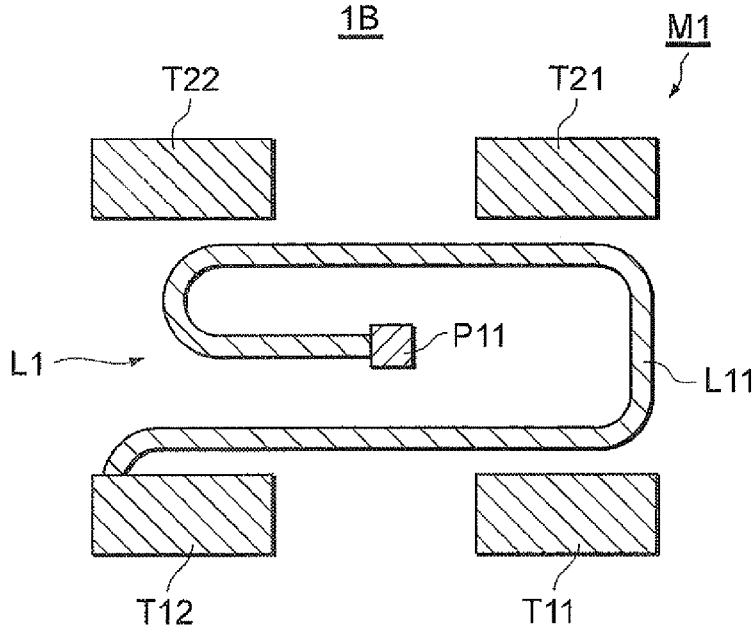
FIG. 18 is a horizontal sectional view of a wiring layer M1 of a coupler 1B.

Referring to FIG. 18, in the wiring layer M1 formed on the insulating substrate 100 (via the insulating film 101), the coiled first line L1 is formed. In Embodiment 1B, the first line L1 formed in the wiring layer M1 has a different number of windings from that of Embodiment 1A, and the position of the inner end also differs from Embodiment 1A. Accordingly, the via P11 of Embodiment 1A, which is connected to the inner end of the first line L1, is arranged in an area close to the isolation terminal T22 (see FIG. 11); whereas, the via P11 of Embodiment 1B, which is connected to the inner end of the first line L1, is arranged at the center portion of the four terminals T11, T12, T21 and T22. Other than the above, the wiring layer M1 has the same configuration as Embodiment 1.

Figure 19:
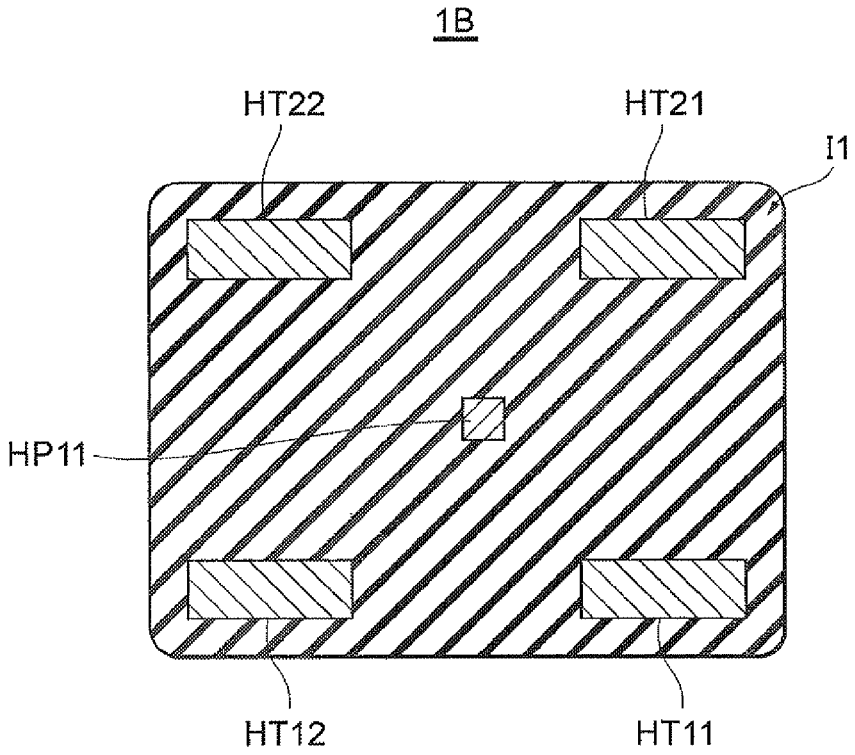
FIG. 19 is a horizontal sectional view of an insulating layer I1 of the coupler 1B.

Referring next to FIG. 19, in the insulating layer I1 formed on the wiring layer M1, the through holes HT11, HT12, HT21 and HT22 are formed at portions corresponding to the respective terminals T11, T12, T21 and T22. Also formed in the insulating layer I1 is the through hole HP11, which is formed at a portion corresponding to the via P11.

Figure 20:
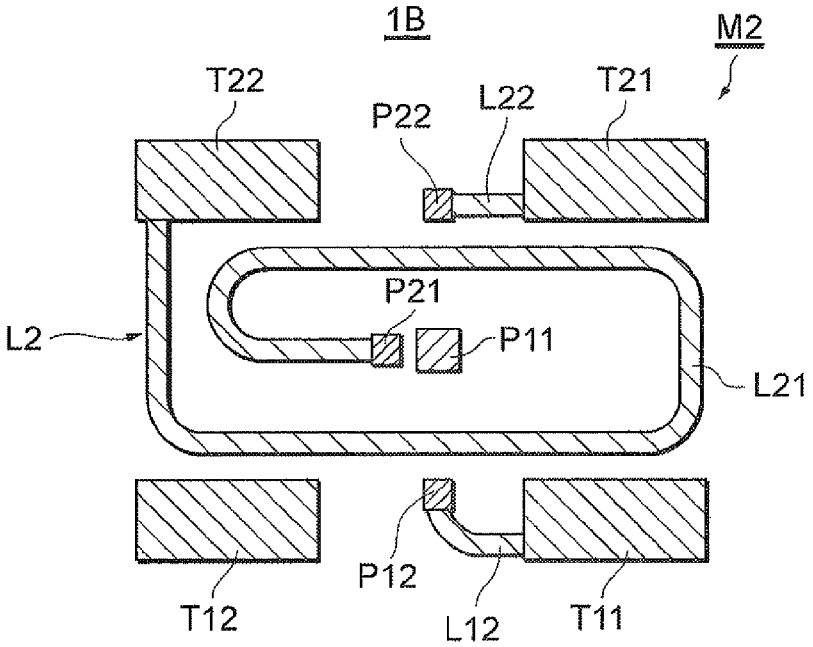
FIG. 20 is a horizontal sectional view of a wiring layer M2 of the coupler 16.

Referring next to FIG. 20, in the wiring layer M2 formed on the insulating layer I1, the coiled second line L2 is formed. In Embodiment 1B, the second line L2 formed in the wiring layer M2 has a different number of windings from that of Embodiment 1A, and the position of the inner end also differs from Embodiment 1A, Accordingly, the via P21 of Embodiment 1A, which is connected to the inner end of the second line L2, is arranged in an area close to the isolation terminal T22 (see FIG. 13); whereas, the via P21 of Embodiment 1B is arranged at the center portion of the four terminals T11, T12, T21 and 122. Also, the connecting wirings L12 and L22 are formed around the secondary line L21, and to what the connecting wirings L12 and L22 are each connected is the same as in Embodiment 1A.

Figure 21:
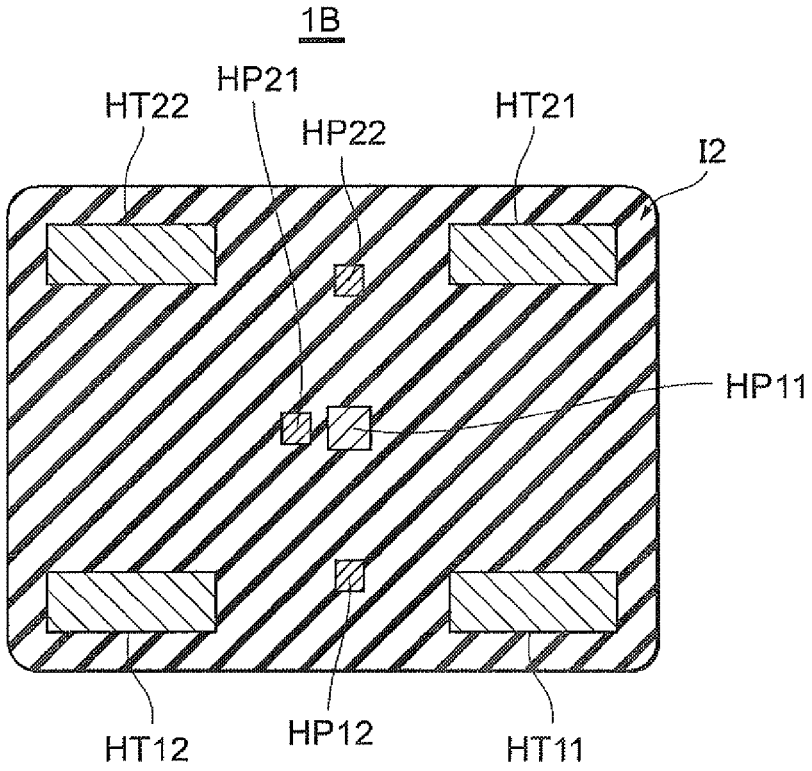
FIG. 21 is a horizontal sectional view of an insulating layer I2 of the coupler 1B.

Referring next to FIG. 21, in the insulating layer I2 formed on the wiring layer M2, the through holes HT11, HT12, HT21 and H122 are formed at portions corresponding to the respective terminals T11, T12, T21 and T22. Also, the through holes HP11, HP12, HP21 and HP22 are formed in the insulating layer I2 at portions corresponding to the vias P11, P12, P21 and P22.

Figure 22:
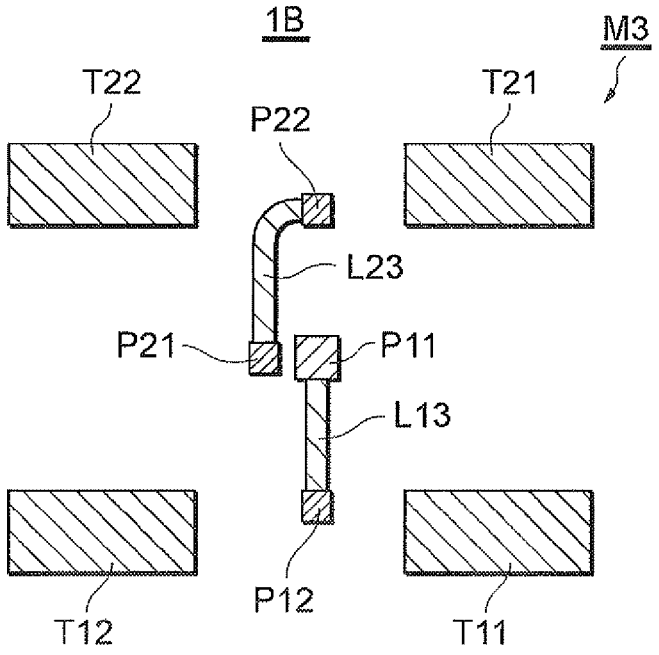
FIG. 22 is a horizontal sectional view of a wiring layer M3 of the coupler 1B.

Referring next to FIG. 22, in the wiring layer M3 formed on the insulating layer I2, the connecting wirings L13 and L23 are formed. Since the positions of the vias P11 and P21 are different from Embodiment 1A, the positions of the connecting wirings L13 and L23 are also different from Embodiment 1A; however, to what the respective wirings L13 and L23 are connected is the same as in Embodiment 1A.

Figure 23:
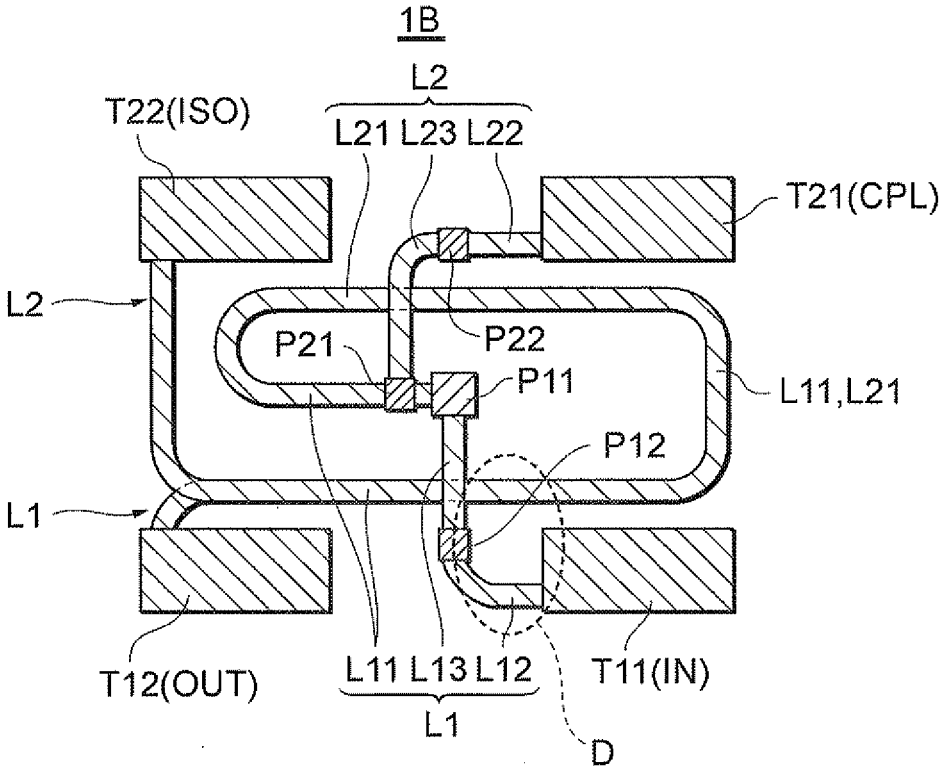
FIG. 23 is a plan view illustrating a wiring layout of the coupler 1B.

FIG. 23 is a plan view showing the wiring layout of the coupler 1B. As shown in FIG. 23, the coupler 1B has: the first line L1 including the main line L11 and the connecting wirings L12 and L13 (first connecting wiring); and the second line L2 including the secondary line L21 and the connecting wirings L22 and L23 (second connecting wiring). As with Embodiment 1A, the main line L11 and the secondary line L21 are arranged in different layers so that electromagnetic coupling is generated between the different layers through the insulating layer I1.

As can be seen from dotted line D in FIGS. 20 and 23, the connecting wiring L12 of the first line L1 is located in the same layer as, and adjacently and parallel to, the secondary line L21 of the second line L2, and as a result, electromagnetic coupling between the first line L1 and the second line L2 in the same layer is ensured. The effect of this configuration is as described in Embodiment 1A.

In Embodiment 1B as well, as with Embodiment 1A, when portions of the same wiring intersect with each other in a plan view, the portions are arranged to be orthogonal to each other at the intersection. For example, in FIG. 23, at the intersection of the connecting wiring L13 and the main line 11, and at the intersection of the connecting wiring L23 and the secondary line L21, the two wirings are arranged to be orthogonal to each other. The effect of this configuration is as described in Embodiment 1A.

Furthermore, in Embodiment 1B as well, as with Embodiment 1A, the via P11 connected to the main line L11 is formed to extend through the insulating layer I1. The effect thereof is as described in Embodiment 1A.

Embodiment 1C

Next, the configuration of a coupler according to Embodiment 1C will be described. FIGS. 24-28 are horizontal sectional views schematically illustrating the respective layers M1-M3 and I1-I2 of a coupler 1C. The pattern of the passivation layer I3 of Embodiment 1C is the same as that of Embodiment 1A. Also, as with Embodiment 1, the terminals T11,T12,T21 and T22 are formed in all the wiring layers M1-M3.

Figure 24:
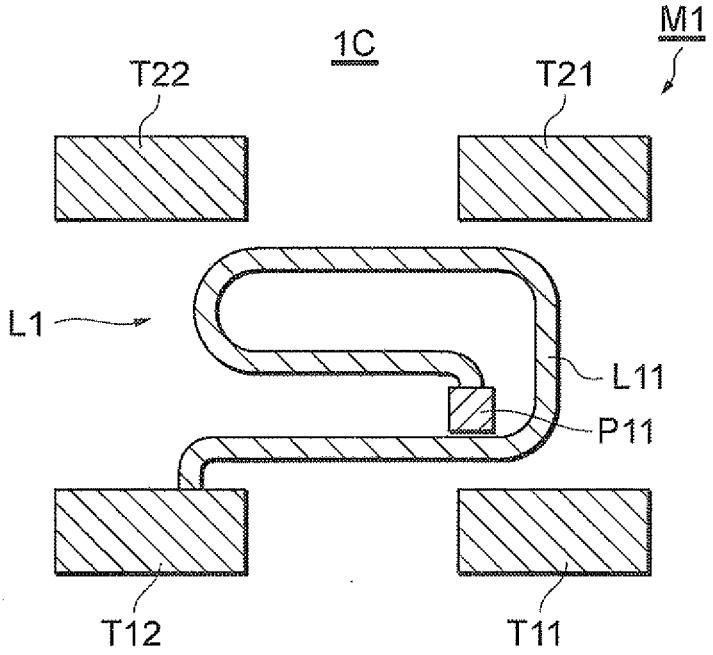
FIG. 24 is a horizontal sectional view of a wiring layer M1 of a coupler 1C.

Referring to FIG. 24, in the wiring layer M1 formed on the insulating substrate 100 (via the insulating film 101), the coiled first line L1 is formed. In Embodiment 1C, the first line L1 formed in the wiring layer M1 has a different number of windings from that of Embodiment 1A, and the position of the inner end also differs from Embodiment 1A. Accordingly, the via P11 of Embodiment 1A, which is connected to the inner end of the first line L1, is arranged in an area close to the isolation terminal T22 (see FIG. 11); whereas, the via P11 of Embodiment 1C, which is connected to the inner end of the first line L1, is arranged in an area close to the input terminal T11. Other than the above, the wiring layer M1 has the same configuration as Embodiment 1.

Figure 25:
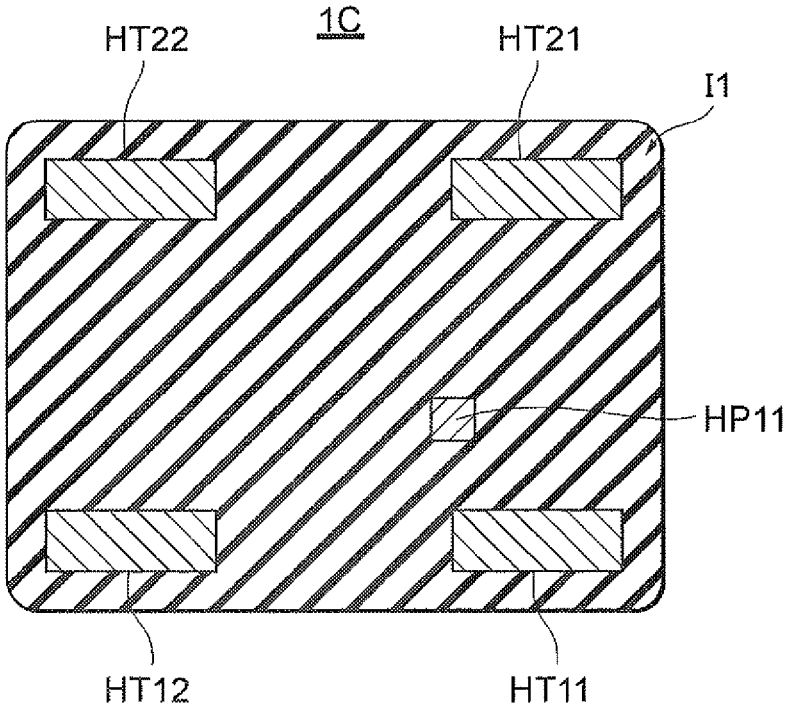
FIG. 25 is a horizontal sectional view of an insulating layer I1 of the coupler 1C.

Referring next to FIG. 25, in the insulating layer I1 formed on the wiring layer M1, the through holes HT11, HT12, HT21 and HT22 are formed at portions corresponding to the respective terminals T11, T12, T21 and T22. Also formed in the insulating layer I1 is the through hole HP11, which is formed at a portion corresponding to the via P11.

Figure 26:
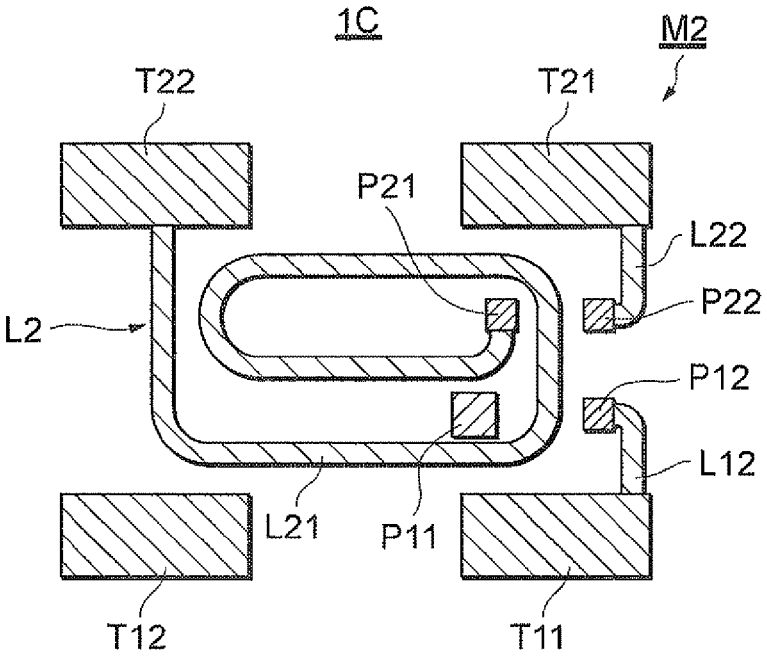
FIG. 26 is a horizontal sectional view of a wiring layer M2 of the coupler 1C.

Referring next to FIG. 26, in the wiring layer M2 formed on the insulating layer I1, the coiled second line L2 is formed. In Embodiment 1C, the second line L2 formed in the wiring layer M2 has a different arrangement and a different number of windings from those of Embodiment 1A, and the position of the inner end also differs from Embodiment 1A. Accordingly, the via P21 of Embodiment 1A, which is connected to the inner end of the second line L2, is arranged in an area close to the isolation terminal T22 (see FIG. 13); whereas, the via P21 of Embodiment 1C is arranged in an area close to the coupling terminal T21. Also, the connecting wirings L12 and L22 are formed around the secondary line L21. The connecting wirings L12 and L22 in the wiring layer M2 of Embodiment 1A are arranged at portions above and below the secondary line L21, respectively, in the plan view shown in FIG. 13; whereas, the connecting wirings L12 and L22 of Embodiment 1C are arranged at the right side of the secondary line L21 in the plan view of FIG. 26. In order to create a space for arranging the connecting wirings L12 and L22 in the above manner, the second line L2 of Embodiment 1C is located closer to the center, compared to Embodiment 1A. Note that to what the connecting wirings L12 and L22 are each connected is the same as in Embodiment 1A.

Figure 27:
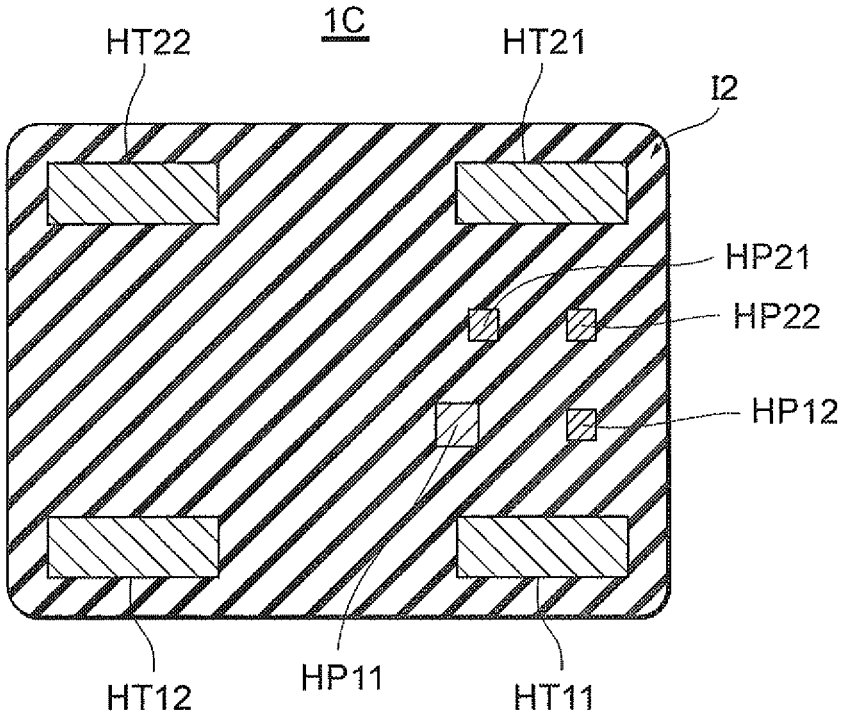
FIG. 27 is a horizontal sectional view of an insulating layer I2 of the coupler 1C.

Referring next to FIG. 27, in the insulating layer I2 formed on the wiring layer M2, the through holes HT11, HT12, HT21 and HT22 are formed at portions corresponding to the respective terminals T11, T12, T21 and T22. Also, the through holes HP11, HP12, HP21 and HP22 are formed in the insulating layer I2 at portions corresponding to the vias P11, P12, P21, and P22.

Figure 28:
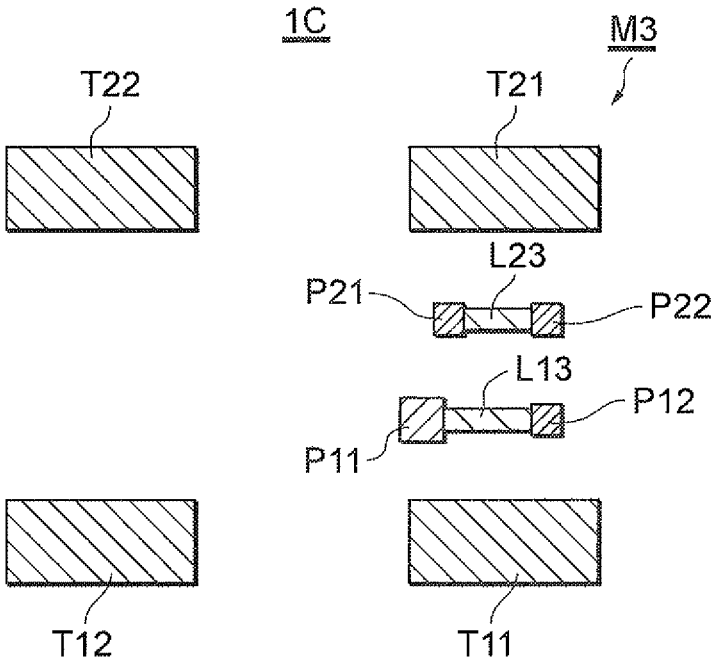
FIG. 28 is a horizontal sectional view of a wiring layer M3 of the coupler 1C.

Referring next to FIG. 28, in the wiring layer M3 formed on the insulating layer I2, the connecting wirings L13 and L23 are formed. The connecting wirings L13 and L23 are arranged to be adjacent and parallel to each other, so as to achieve electromagnetic coupling between them. Since the positions of the vias P11, P12, P21 and P22 are different from Embodiment 1A, the positions of the connecting wirings L13 and L23 of Embodiment 1C are also different from Embodiment 1A; however, to what the wirings L13 and L23 are each connected is the same as in Embodiment 1A.

Figure 29:
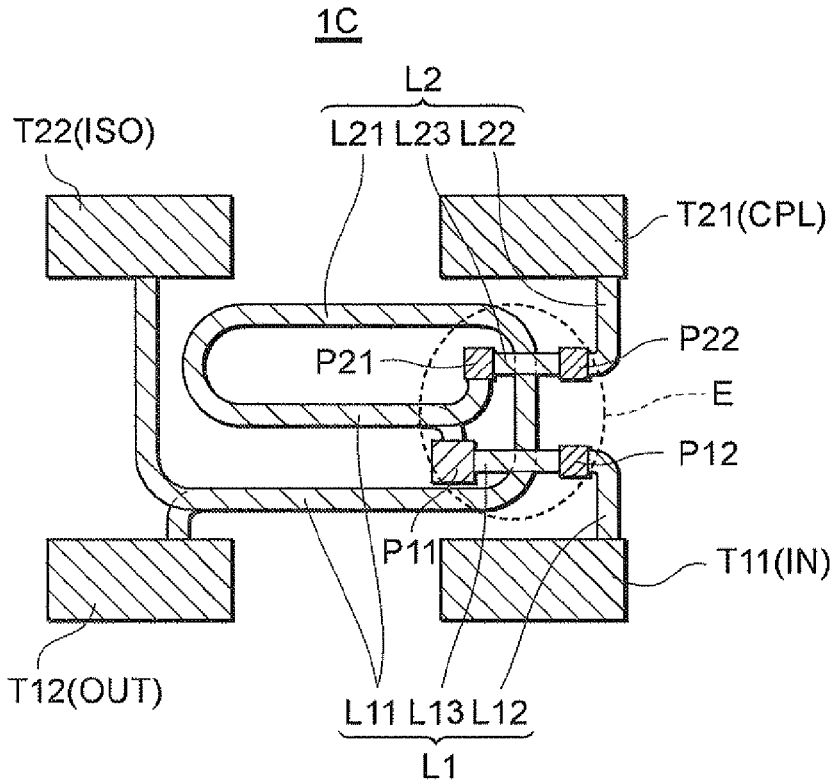
FIG. 29 is a plan view illustrating a wiring layout of the coupler 1C.

FIG. 29 is a plan view showing the wiring layout of the coupler 1C. As shown in FIG. 29, the coupler 1C has: the first line L1 including the main line L11 and the connecting wirings L12 and L13 (first connecting wiring); and the second line L2 including the secondary line L21 and the connecting wirings L22 and L23 (second connecting wiring). As with Embodiment 1A, the main line L11 and the secondary line L21 are arranged in different layers, so that electromagnetic coupling is generated between different layers through the insulating layer I1.

As can be seen from dotted line E in FIGS. 28 and 29, the connecting wiring L13 of the first line L1 is located in the same layer as, and adjacently and parallel to, the connecting wiring L23 of the second line L2, and as a result, electromagnetic coupling between the first line L1 and the second line L2 in the same layer is ensured. The effect of the above configuration is as described in Embodiment 1A.

In Embodiment 1C as well, as with Embodiment 1A, when portions of the same wiring intersect with each other in a plan view, the portions are arranged to be orthogonal to each other at the intersection. For example, in FIG. 29, at the intersection of the connecting wiring L13 and the main line 11, and at the intersection of the connecting wiring L23 and the secondary line L21, the two wirings are arranged to be orthogonal to each other. The effect of this configuration is as described in Embodiment 1A.

Furthermore, in Embodiment 1C as well, as with Embodiment 1A, the via P11 connected to the main line L11 is formed to extend through the insulating layer I1. The effect thereof is as described in Embodiment 1A.

Embodiment 1D

Next, the configuration of a coupler according to Embodiment 1D will be described. FIGS. 30-34 are horizontal sectional views schematically illustrating the respective layers M1-M3 and I1-I2 of a coupler 1D. The pattern of the passivation layer I3 of Embodiment 1D is the same as that of Embodiment 1A. Also, as with Embodiment 1, the terminals T11,T12,T21 and T22 are formed in all the wiring layers M1-M3.

Figure 30:
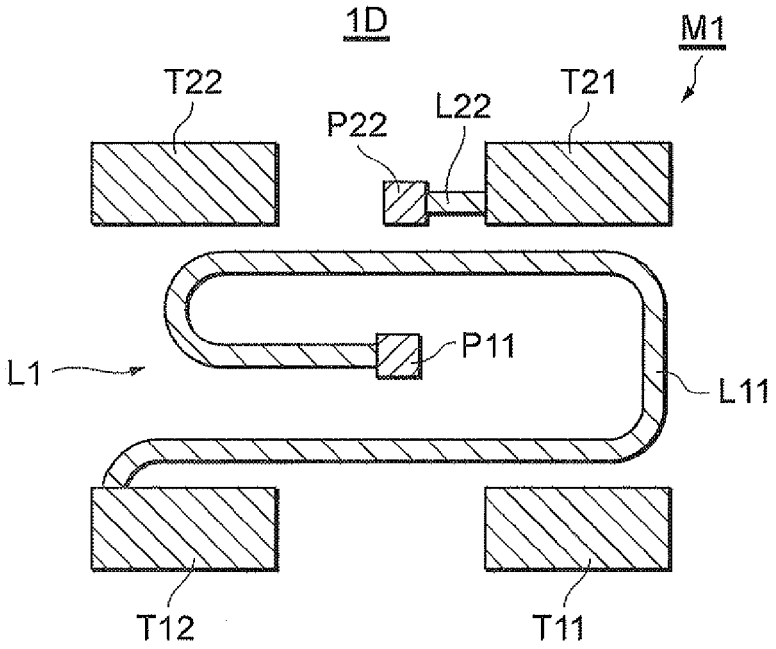
FIG. 30 is a horizontal sectional view of a wiring layer M1 of a coupler 1D.

Referring to FIG. 30, in the wiring layer M1 formed on the insulating substrate 100 (via the insulating film 101), the coiled first line L1 is formed. In Embodiment 1D, the first line L1 formed in the wiring layer M1 has a different number of windings from that of Embodiment 1A, and the position of the inner end also differs from Embodiment 1A. In Embodiment 1D, as with Embodiment 1B, the via P11 connected to the inner end of the first line L1 is arranged at the center portion of the four terminals T11, T12, T21 and T22. Also, in Embodiment 1D, unlike Embodiment 1A, the connecting wiring L22, which constitutes a portion of the second line L2, is formed in the wiring layer M1, outside the first line L1. One end of the connecting wiring L22 is connected to the coupling terminal T21 and the other end is connected to the via P22. The via P22 extends through the insulating layers I1 and I2 to the wiring layer M3. Other than the above, the configuration of the wiring layer M1 is the same as Embodiment 1.

Figure 31:
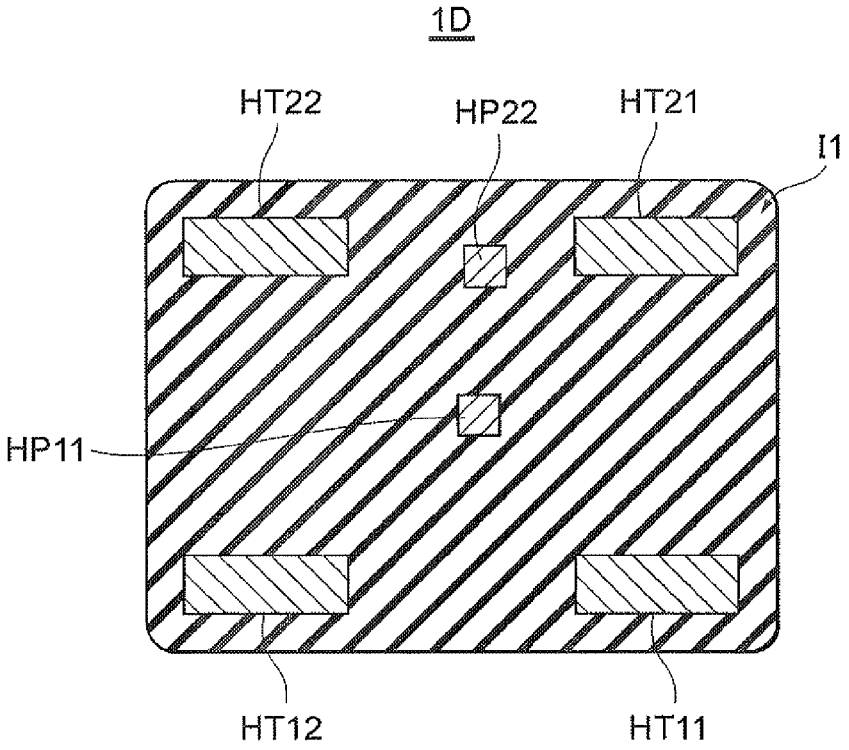
FIG. 31 is a horizontal sectional view of an insulating layer I1 of the coupler 1D.

Referring next to FIG. 31, in the insulating layer I1 formed on the wiring layer M1, the through holes HT11, HT12, HT21 and HT22 are formed at portions corresponding to the respective terminals T11, T12, T21 and T22. Also formed in the insulating layer I1 are the through holes HP11 and HP22, which are formed at portions corresponding to the vias P11 and P22.

Figure 32:
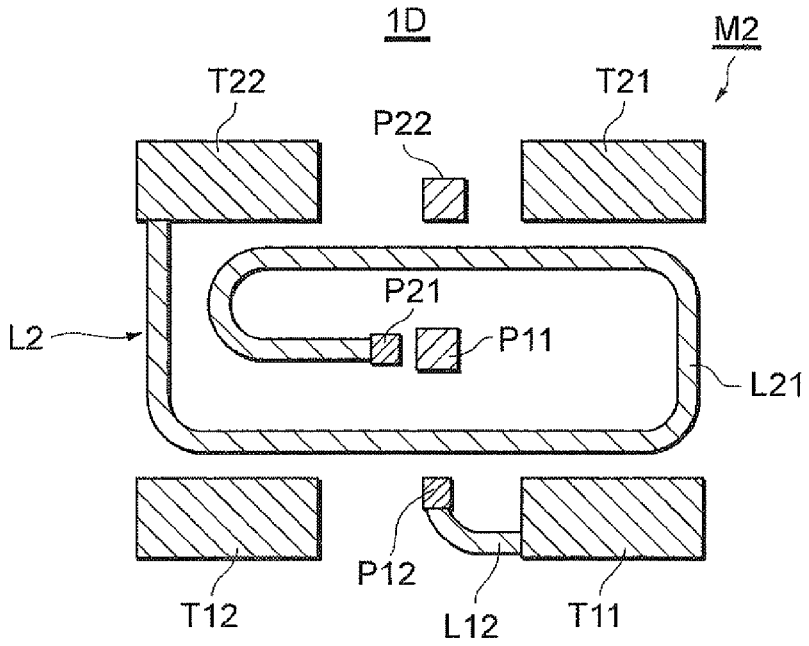
FIG. 32 is a horizontal sectional view of a wiring layer M2 of the coupler 1D.

Referring next to FIG. 32, in the wiring layer M2 formed on the insulating layer I1, the coiled second line L2 is formed. In Embodiment 1D, the second line L2 formed in the wiring layer M2 has a different number of windings from that of Embodiment 1A, and the position of the inner end also differs from Embodiment 1A. Accordingly, in Embodiment 1D, as with Embodiment 1B, the via P21 connected to the inner end of the second line L2 is arranged at the center portion of the four terminals T11, T12, T21 and T22. Also, as with Embodiment 1A, the connecting wiring L12 is arranged around the secondary line L21; however, unlike Embodiment 1A, the connecting wiring L22 is not formed in the wiring layer M2.

Figure 33:
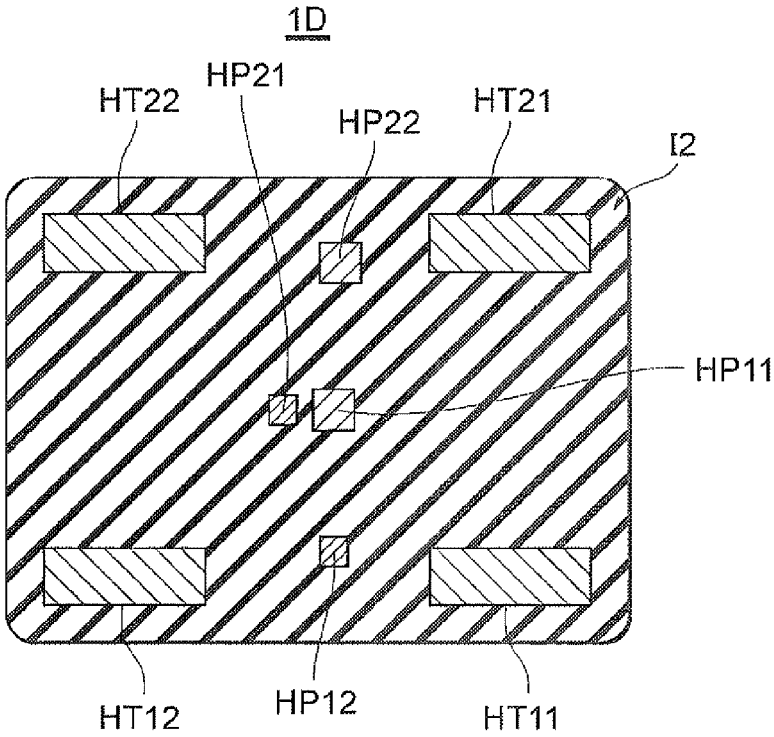
FIG. 33 is a horizontal sectional view of an insulating layer I2 of the coupler 1D.

Referring next to FIG. 33, in the insulating layer I2 formed on the wiring layer M2, the through holes HT11, HT12, HT21 and HT22 are formed at portions corresponding to the respective terminals T11, T12, T21 and T22. Also, the through holes HP11, HP12, HP21 and HP22 are formed in the insulating layer I2 at portions corresponding to the vias P11, P12, P21 and P22.

Figure 34:
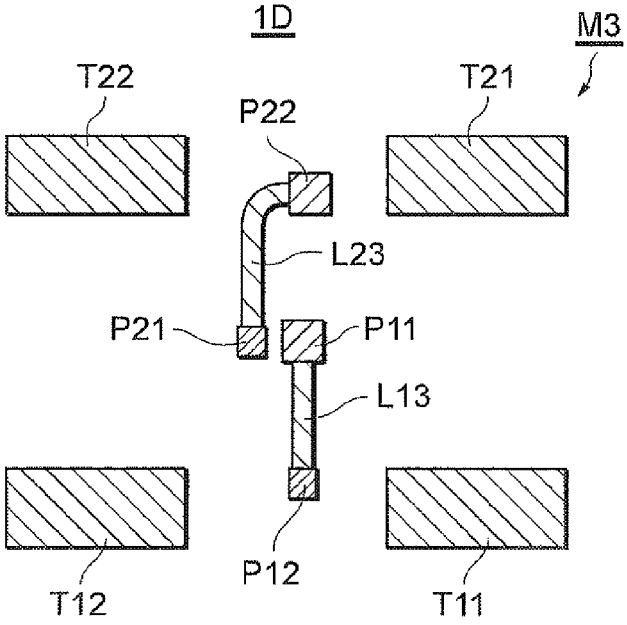
FIG. 34 is a horizontal sectional view of a wiring layer M3 of the coupler 1D.

Referring next to FIG. 34, in the wiring layer M3 formed on the insulating layer I2, the connecting wirings L13 and L23 are formed. The arrangement of the connecting wirings L13 and L23 in Embodiment 1D is different from Embodiment 1A, but the same as Embodiment 1B.

Figure 35:
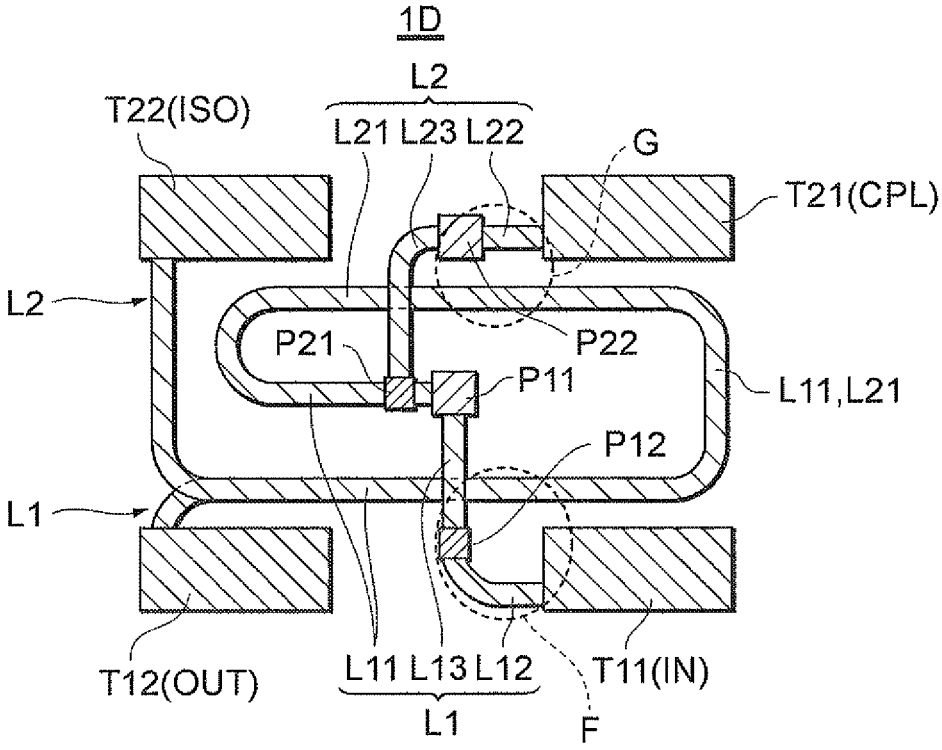
FIG. 35 is a plan view illustrating a wiring layout of the coupler 10.

FIG. 35 is a plan view showing the wiring layout of the coupler 1D. As shown in FIG. 35, the coupler 1D has: the first line L1 including the main line L11 and the connecting wirings L12 and L13 (first connecting wiring); and the second line L2 including the secondary line L21 and the connecting wirings L22 and L23 (second connecting wiring). As with Embodiment 1A, the main line L11 and the secondary line L21 are arranged in different layers so that electromagnetic coupling is generated between the different layers through the insulating layer I1.

As can be seen from dotted line F in FIG. 35, the connecting wiring L12 of the first line L1 is located in the same layer as, and adjacently and parallel to, the secondary line L21 of the second line L2, and as a result, electromagnetic coupling between the first line L1 and the second line L2 in the same layer is ensured. Also, as can be seen from dotted line G in FIG. 35, the connecting wiring L22 of the second line L2 is located in the same layer as, and adjacently and parallel to, the main line L11 of the first line L1, and as a result, electromagnetic coupling between the first line L1 and the second line L2 in the same layer is ensured. The effect of the above configuration is as described in Embodiment 1A.

In Embodiment 1D as well, as with Embodiment 1A, when portions of the same wiring intersect with each other in a plan view, the portions are arranged to be orthogonal to each other at the intersection. For example, in FIG. 35, at the intersection of the connecting wiring L13 and the main line 11, and at the intersection of the connecting wiring L23 and the secondary line L21, the two wirings are arranged to be orthogonal to each other. The effect of this configuration is as described in Embodiment 1A.

Furthermore, in Embodiment 1D as well, as with Embodiment 1A, the via P11 connected to the main line L11 is formed to extend through the insulating layer I1. The effect thereof is as described in Embodiment 1A.

As mentioned before, the invention is not limited to the respective embodiments above, and can be modified in various ways without changing the gist of the invention. For example, the second line may be wired out to the first line using the via, instead of wiring out the first line to the second line. Also, there is no limitation on the order of the wiring layers stacked on the substrate, and for example, the secondary line may be arranged closer to the substrate than the main line. Also, the positions of the terminals T11, T12, T21 and T22 may be changed arbitrarily, and depending on such change of the positions of the terminals, the wiring layout may also be changed. Also, various types of coil arrangements may be employed without departing from the gist of the invention.

Since the invention can provide a coupler that is thinner and smaller in size and still satisfies the required various properties of couplers, the invention can be utilized, in particular, in radio communication devices, apparatuses, modules and systems that require thinner and smaller sizes, as well as equipment provided with such devices, etc., and can also widely be used in the manufacturing thereof.

According to an aspect of the invention, at least one of the first line and the second line is wired out through the via to the same side of the insulating layer as the other one of the first and second lines, and the first and second lines can thus share wiring layers in which the respective lines are to be formed. As a result, the number of layers in the coupler can be reduced, and this reduction of layers allows a thinner coupler. Accordingly, thinner and smaller couplers can be achieved while maintaining the various properties of the couplers.

Also, according to another aspect of the invention, electromagnetic coupling between the first and second lines is generated not only in different layers but also within the same layer, and thus, the coupling in the coupler can be increased. Accordingly, thinner and smaller couplers can be achieved while maintaining the required various properties of the couplers.

What is claimed is:

1. A coupler comprising:

a first line that includes a coiled main line and is constituted by separate portions arranged in different layers;

a second line that includes a coiled secondary line arranged to be opposed to the main line via an insulating layer, the second line being constituted by separate portions arranged in different layers;

a plurality of vias connecting the separate portions of the first line arranged in the different layers to each other and connecting the separate portions of the second line arranged in the different layers to each other; and a plurality of terminals each connected to an end of the first and second lines, wherein:

all the terminals are arranged on a periphery. along a same planar surface, and separate from the coiled main line and the coiled secondary line, the vias include an extension via connected to the main line or the secondary line and extending through the insulating layer, and the extension via wires the first line to the insulating layer on a same side as the second line, and the extension via wires the second line to the insulating layer on a same side as the first line.

2. The coupler according to claim 1, wherein the vias include a via connected to an inner end of the main line and a via connected to an inner end of the secondary line.

3. The coupler according to claim 1, wherein the vias include a prismatic via having corners in a cross-section parallel to the insulating layer, and wherein the corners of the prismatic via face the terminals in the cross-section parallel to the insulating layer.

4. The coupler according to claim 1, wherein the vias include a cylindrical via having a circular portion in a cross-section parallel to the insulating layer.

5. The coupler according to claim 1, wherein the terminals include four terminals, and the vias are arranged so that at least one of the vias is at a center of the four terminals.

6. A coupler comprising:

a first line including a main line and a first connecting wiring;

a second line including a secondary line and a second connecting wiring; and a plurality of terminals each connected to an end of the first and second lines. wherein:

all the terminals are arranged on a periphery, along a same planar surface, and separate from the coiled main line and the coiled secondary line, the main line and the secondary line are arranged in different layers via an insulating layer such that electromagnetic coupling is generated between the main line and the secondary line, and at least one of the first connecting wiring and the second connecting wiring is arranged in the same layer as the first line or the second line such that electromagnetic coupling between the first line and the second line is generated in the same layer.

7. The coupler according to claim 6, wherein at least part of the first connecting wiring and at least part of the second line are arranged adjacently to each other in the same layer.

8. The coupler according to claim 6, wherein at least part of the first connecting wiring and at least part of the secondary line are arranged adjacently to each other in the same layer.

9. The coupler according to claim 6, wherein at least part of the second connecting wiring and at least part of the main line are arranged adjacently to each other in the same layer.

10. The coupler according to claim 6, wherein portions of one wiring which intersect with each other in a plan view are arranged to be orthogonal to each other at the intersection.

11. The coupler according to claim 6, further comprising a via connected to the main line or the secondary line and extending through the insulating layer, wherein the via wires out at least one of the first line and the second line to the same side of the insulating layer as the other one of the first line and the second line.

12. The coupler according to claim 6, comprising:

a first layer including at least the main line;

a second layer including at least the secondary line; and a third layer including at least part of the first connecting wiring and/or the second connecting wiring.

* * * * *